US006790047B2

(12) United States Patent
Togashi

(10) Patent No.: US 6,790,047 B2
(45) Date of Patent: Sep. 14, 2004

(54) COAXIAL CONNECTOR WITH SWITCH

(75) Inventor: Koji Togashi, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/621,025

(22) Filed: Jul. 15, 2003

(65) Prior Publication Data

US 2004/0121625 A1 Jun. 24, 2004

(30) Foreign Application Priority Data

Aug. 7, 2002 (JP) ..... 2002-230535

(51) Int. Cl.[7] ..... H01R 12/00

(52) U.S. Cl. ..... 439/63; 439/188; 439/62; 439/944

(58) Field of Search ..... 439/188, 62, 63, 439/944; 200/51.09, 504, 51.1, 51.2

(56) References Cited

U.S. PATENT DOCUMENTS 4,633,048 A * 12/1986 Komatsu ..... 200/51.1
5,267,871 A * 12/1993 Flanagan ..... 439/188
5,478,258 A * 12/1995 Wang ..... 439/581
6,000,953 A * 12/1999 Quillet et al. ..... 439/79
6,065,976 A * 5/2000 Wang ..... 439/63
6,146,167 A * 11/2000 Kutsch ..... 439/188
6,468,089 B1 * 10/2002 Hubbard et al. ..... 439/63
6,659,784 B1 * 12/2003 Klein et al. ..... 439/188

* cited by examiner

*Primary Examiner*—Renee Luebke
*Assistant Examiner*—Briggitte R. Hammond
(74) *Attorney, Agent, or Firm*—Darby & Darby

(57) ABSTRACT

A coaxial connector with a switch can be used even when an internal ANT and an RF circuit on a printed wiring board are inversely arranged by mounting the connector through the reverse mounting. The connector is mounted on a printed wiring board by engaging a notch portion in an edge thereof and comprises a normally closed terminal, a common terminal, an insulator, a shell, and a housing. A pair of connecting portions of the shell are horizontally symmetric with respect to a vertical plane passing the center or nearly the center of the housing. The connecting portions of the normally closed terminal and the common terminal are also horizontally symmetric with respect to the vertical plane. A top surface and a bottom surface of each of the connecting portions are vertically symmetric with respect to a horizontal plane passing the centers or nearly the centers of the connecting portions.

18 Claims, 22 Drawing Sheets

Normal Mounting

Reverse Mounting

Fig. 7(a)
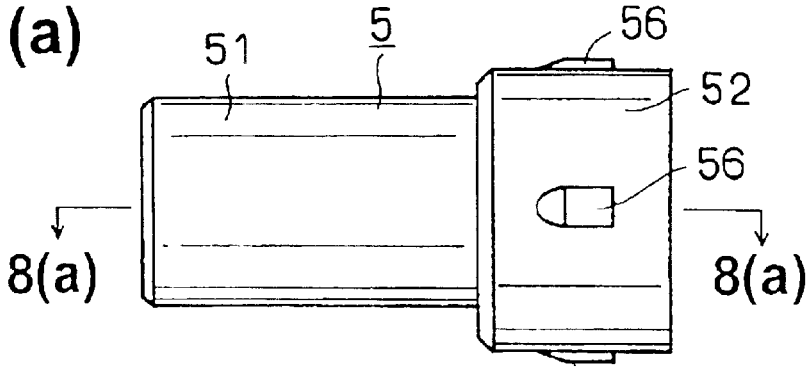
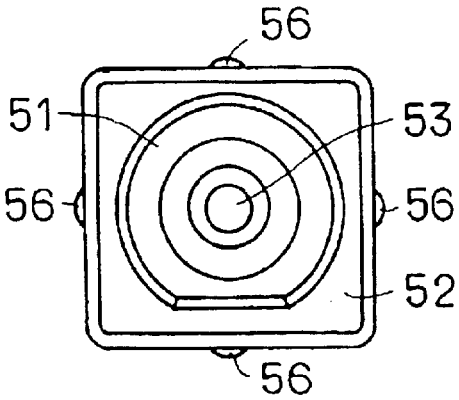
Fig. 7(b)
Fig. 7(c)
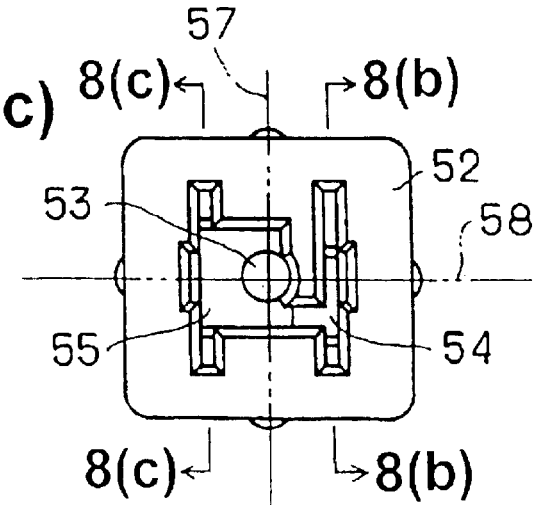

Fig. 9(a)
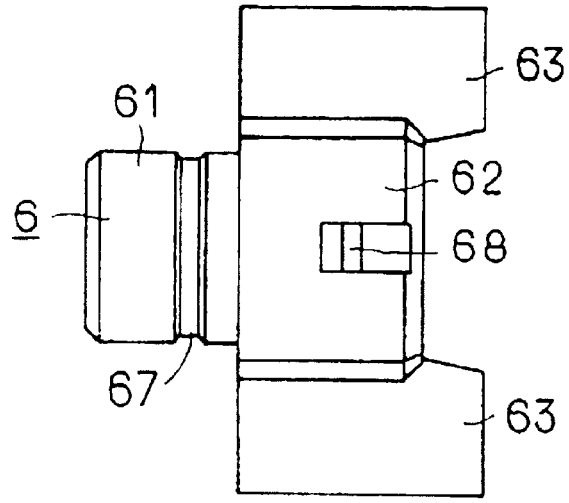
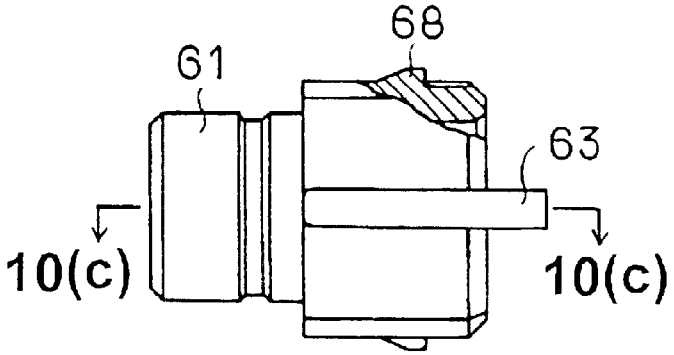
Fig. 9(b)
Fig. 9(c)
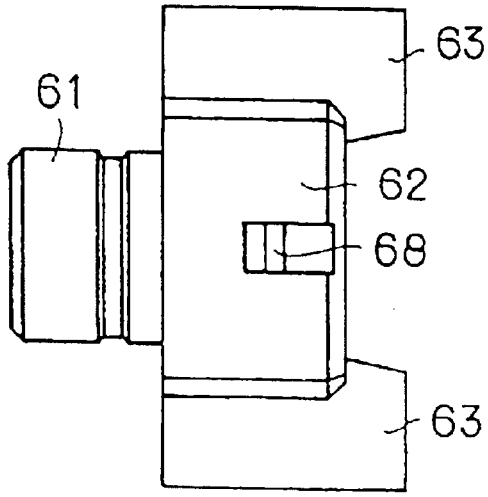

Fig. 10(a)
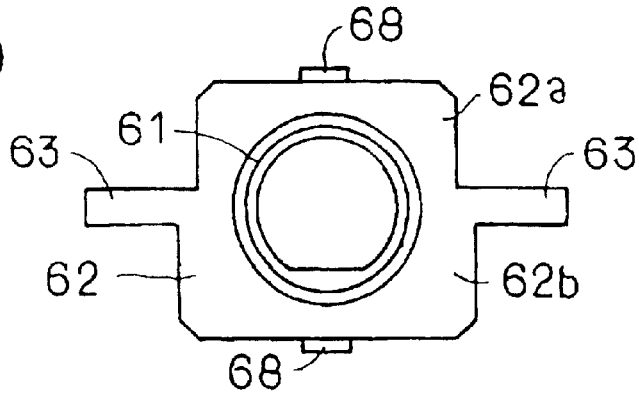
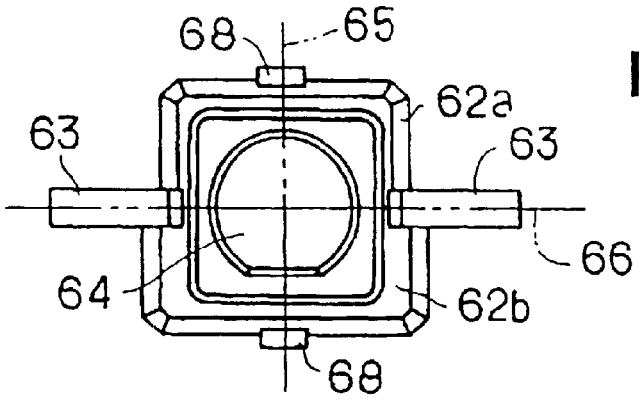
Fig. 10(b)
Fig. 10(c)
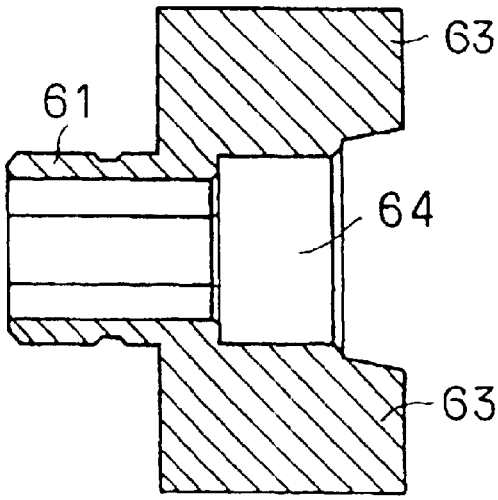

Fig. 11(a)
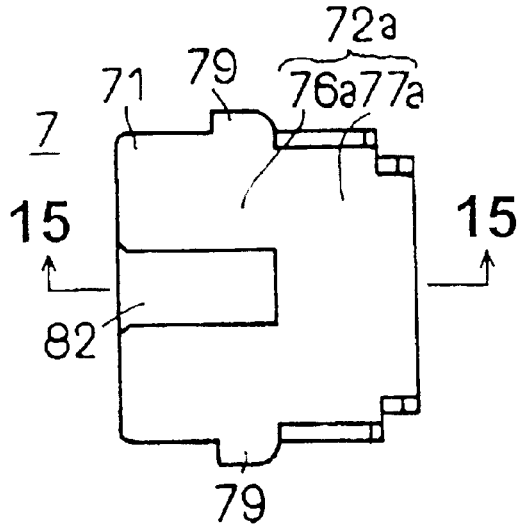
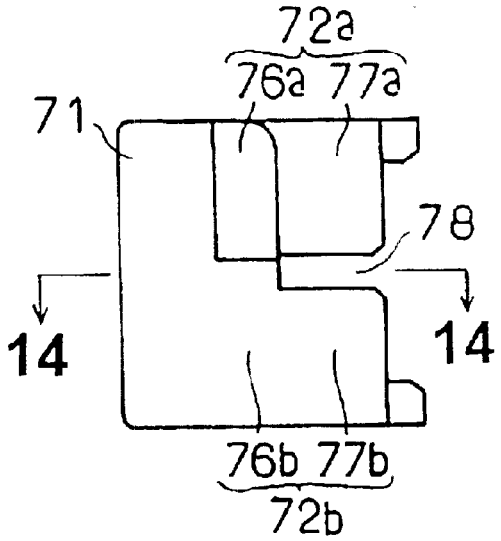
Fig. 11(b)
Fig. 11(c)
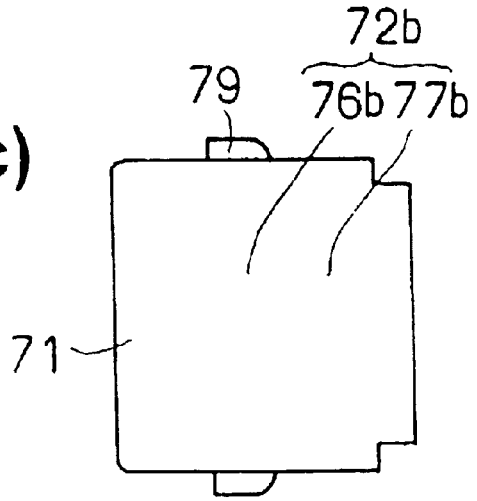

COAXIAL CONNECTOR WITH SWITCH

BACKGROUND OF THE INVENTION

1. Field of the Invention

The present invention relates to a coaxial connector with a switch, such as a receptacle type coaxial connector with a switch. The coaxial connector comprises a normally closed terminal and a common terminal whose respective contact portions contact and move apart from each other in association with the removal and insertion of a mating connector, such as a plug type coaxial connector, as a central conductor and a shell as an exterior conductor. The coaxial connector is mounted on a printed wiring board by soldering connecting portions of the normally closed terminal, the common terminal, and the shell to their respective corresponding lands on the printed wiring board.

2. Description of the Related Art

A common terminal is a type of terminal that can be alternately connected to one or more separate terminals.

A normally closed terminal is a type of terminal that, in its normal, default state, remains connected to another terminal until the normally closed terminal is disconnected from the other terminal, for example, by releasing a switch.

A conventional coaxial connector 300, 400 with a switch, as shown in FIG. 21(*b*) and FIG. 22(*b*), includes a common terminal and a normally closed terminal. When the mating connector 500 is disconnected from the conventional coaxial connector 300, 400, the normally closed terminal is in the normal, default state, and the common terminal and the normally closed terminal are connected by the switch. Upon the insertion of the mating connector 500 into the conventional coaxial connector 300, 400, the switch is released, thereby disconnecting the common terminal from the normally closed terminal.

Conventionally, a coaxial connector with a switch of this type is formed as a right angle type, in which each of the connecting portions of the normally closed terminal, the common terminal, and the shell is formed into a vertically asymmetric shape. For this reason, for a printed wiring board having a reversed layout, such as a circuit (or element) to be connected to the common terminal and a circuit (or element) to be connected to the normally closed terminal on the printed wiring board, it is necessary to prepare a separate coaxial connector with a switch having the connecting portion of the common terminal and the connecting portion of the normally closed terminal arranged inversely.

For example, given a coaxial connector 300 with a switch as the connector to be mounted in a case where an internal antenna (ANT) 101 and an RF (high-frequency) circuit 102 are laid out on a printed wiring board 100 as shown in FIG. 21(*b*) and FIG. 23(*c*), and given a coaxial connector 400 with a switch as the connector to be mounted in a case where an internal ANT 201 and an RF circuit 202 are laid out inversely on a printed wiring board 200 as shown in FIG. 22(*b*) and FIG. 24(*c*), then the arrangement of a connecting portion 301 of the normally closed terminal and a connecting portion 302 of the common terminal of the coaxial connector 300 with a switch is reversed with respect to the arrangement of a connecting portion 401 of the normally closed terminal and a connecting portion 402 of the common terminal of the coaxial connector 400 with a switch as shown in FIG. 23(*b*) and FIG. 24(*b*), respectively.

In the case shown in FIG. 21(*b*) and FIG. 23(*c*), the connecting portion 301 of the normally closed terminal and the connecting portion 302 of the common terminal of the coaxial connector 300 with a switch are placed respectively on lands 103 and 104 for the use of signals formed on the printed wiring board 100, and connecting portions 303 and 303 of the shell of the coaxial connector 300 with a switch are placed respectively on lands 105 and 105 for the use of grounding formed on the printed wiring board 100. Each connecting portion is connected to the corresponding land through soldering (not shown). The lands 103 and 104 are connected to the internal ANT 101 and the RF circuit 102 through wiring patterns 106 and 107, respectively.

As shown in FIG. 21(*a*) and FIG. 21(*b*), when a mating connector 500 is not inserted, a contact portion of the common terminal and a contact portion of the normally closed terminal of the coaxial connector 300 with a switch come in elastic contact with each other, whereby the internal ANT 101 is electrically connected to the RF circuit 102.

When the mating connector 500 is inserted, the contact between the contact portions of the normally closed terminal and the common terminal of the coaxial connector 300 with a switch is released by a contact portion of a normally open terminal (for example, a center pin) 501 of the mating connector 500, and the contact portion of the normally open terminal 501 is brought into elastic contact with the contact portion of the common terminal of the coaxial connector 300 with a switch, whereby an external ANT (not shown) connected to the end portion of a coaxial cable 600 is electrically connected to the RF circuit 102.

In short, the ANT to be connected to the RF circuit 102 is switched from the internal ANT 101 to the external ANT. When the mating connector 500 is inserted, the contact portion of a shell (grounded terminal) 502 of the mating connector 500 comes in elastic contact with the contact portion of the shell of the coaxial connector 300 with a switch, whereby an electrical connection is established there between.

In the case shown in FIG. 22(*b*) and FIG. 24(*c*), the connecting portion 402 of the common terminal and the connecting portion 401 of the normally closed terminal of the coaxial connector 400 with a switch are placed respectively on lands 204 and 203 for the use of signals formed on the printed wiring board 200, and connecting portion 403 and 403 of the shell of the coaxial connector 400 with a switch are placed respectively on lands 205 and 205 for the use of grounding formed on the printed wiring board 200. Each connecting portion is connected to the corresponding land through soldering. The lands 204 and 203 are connected to the RF circuit 202 and the internal ANT 201 through wiring patterns 207 and 206, respectively.

As shown in FIG. 22(*a*) and FIG. 22(*b*), when the mating connector 500 is not inserted, as with the case of FIG. 21(*a*) and FIG. 21(*b*), the internal ANT 201 is electrically connected to the RF circuit 202. When the mating connector 500 is inserted, as with the case of FIG. 21(*a*) and FIG. 21(*b*), the ANT to be electrically connected to the RF circuit 202 is switched from the internal ANT 201 to the external ANT.

In the conventional examples shown in FIG. 21(*a*) through FIG. 24(*c*), however, the coaxial connectors 300 and 400 with switches are formed as a right angle type, and the connecting portions 301 and 302 and the connecting portions 401 and 402 of the respective terminals and the connecting portions 303 and 303 and the connecting portions 403 and 403 of the respective shells are formed into vertically asymmetric shapes. Hence, onto the printed wiring board 100 on which the internal ANT 101 and the RF circuit 102 are laid out as shown in FIG. 23(*c*), of the coaxial connectors 300 and 400 with switches, only the coaxial connector 300 with a switch is allowed to mount. Conversely, onto the printed wiring board 200 on which the internal ANT 201 and the RF circuit 202 are laid out as shown in FIG. 24(*c*), only the other coaxial connector 400 with a switch is allowed to mount.

As has been described, when the internal ANT and the RF circuit laid out on the printed wiring board are arranged inversely, it is necessary to prepare different coaxial connectors with switches that conform to the respective printed wiring boards. This makes it impossible to use a coaxial connector with a switch commonly, which poses a problem that the manufacturing facilities are increased and so are the costs.

SUMMARY OF THE INVENTION

The invention was devised in view of the foregoing problems, and therefore, has an object to provide a coaxial connector with a switch that can be used commonly even when the internal ANT and the RF circuit laid out on the printed wiring board are arranged inversely, and therefore, can save the costs by suppressing an increase of the manufacturing facilities.

An aspect of the invention provides a coaxial connector (10) with a switch, which includes: a normally closed terminal (3) and a common terminal (4) whose respective contact portions (31)(44) come in contact with and move apart from each other in association with removal and insertion of a mating connector (9); an insulator (5) for holding the normally closed terminal (3) and the common terminal (4); and a shell (6) for holding the insulator (5) from outside, a connecting portion (33) of the normally closed terminal (3), a connecting portion (43) of the common terminal (4), and a pair of connecting portions (63)(63) of the shell (6) being protruded in a horizontal direction to be placed on corresponding lands (13, 23)(14, 24)(15, 25)(15, 25) formed on a surface of a printed wiring board (1, 2) near an edge thereof, the coaxial connector (10) with a switch being mounted onto the edge of the printed wiring board (1, 2) through soldering of each connecting portion, wherein: the pair of connecting portions (63)(63) of the shell (6) are placed at horizontally symmetric positions with respect to a vertical plane (65) passing a center or nearly the center of the shell (6); the connecting portion (33) of the normally closed terminal (3) and the connecting portion (43) of the common terminal (4) are placed at horizontally symmetric positions with respect to the vertical plane (65); and a top surface and a bottom surface of each of the connecting portions (63)(63)(33)(43) are formed into vertically symmetric shapes with respect to a horizontal plane (66) passing centers or nearly the centers of the connecting portions (63)(63)(33)(43).

According to the above arrangement, the pair of connecting portions (63)(63) of the shell (6) are placed at horizontally symmetric positions with respect to the vertical plane (65) passing the center or nearly the center of the shell (6); the connecting portion (33) of the normally closed terminal (3) and the connecting portion (43) of the common terminal (4) are placed at horizontally symmetric positions with respect to the vertical plane (65); and the top surface and the bottom surface of each of the connecting portions (63)(63)(33)(43) are formed into vertically symmetric shapes with respect to the horizontal plane (66) passing the centers or nearly the centers of the connecting portions (63)(63)(33)(43). Consequently, in a case where the lands (13, 23)(14, 24)(15, 25)(15, 25) formed on the surface of the printed wiring board (1, 2) near the edge thereof are arranged inversely, the coaxial connector (10) with a switch can be mounted onto the edge of the printed wiring board (1, 2) through the reverse mounting by merely reversing the coaxial connector (10) with a switch.

In other words, in a case where the arrangement of two circuits or elements (including a case where one of them is an element or both are elements) laid out on the printed wiring board (1, 2) is reversed, for example, when the layout of an internal ANT and an RF circuit is arranged inversely, the same coaxial connector (10) with a switch can be used through the reverse mounting, which makes it possible to use the coaxial connector (10) with a switch commonly.

Another aspect of the invention provides the coaxial connector (10) with a switch according to the aspect of the invention described above, wherein a horizontal plane passing the center or nearly the center of the shell (6) is given as the horizontal plane (66), so that the heights of the coaxial connector (10) with a switch from the main surface and from the back surface of the printed wiring board (1, 2) are made almost equal when mounted.

Another aspect of the invention provides the coaxial connector (10) with a switch according to an aspect of the invention described above, wherein: the shell (6) includes a main body portion (62) allowed to engage with two kinds of notch portions (11)(21) having different shapes formed by making a notch in the edge of the printed wiring board (1, 2); the main body portion (62) includes an upper main body portion **(62*a*) and a lower main body portion (62*b*) partitioned vertically at the horizontal plane (66); and one of the upper main body portion (62*a*) and the lower main body portion (62*b*) is formed into a shape allowed to engage with only one of the two kinds of notch portions (11)(21), and the other is formed into a shape allowed to engage with only the other one of the two kinds of notch portions (11)(21), so that erroneous mounting can be prevented while reducing the protrusion length from the edge of the printed wiring board (1, 2)** when mounted.

Another aspect of the invention provides the coaxial connector (10) with a switch according to an aspect of the invention described above, wherein: one of the two kinds of notch portions (11)(21) is formed to have an opening width of a constant value V from an opening side to an inner side, and the other is formed to have two steps having an opening width V1 (V1>V) on the opening side and an opening width V2 (V2<V) on the inner side; the lower main body portion **(62*b*) is formed to have a breadth of a constant value W slightly less than V; and the upper main body portion (62*a*) is formed to have two steps having a breadth W2 (W2 takes a value slightly less than V2) on an engagement tip end side and a breadth W1 (W1 takes a value slightly less than V1) on an engagement rear end side, so that the outside shape of the shell (6) and the shapes of the notch portions (11)(21)** can be simple.

Another aspect of the invention provides a coaxial connector (10) with a switch, which includes: a normally closed terminal (3) and a common terminal (4) whose respective contact portions (31)(44) come in contact with and move apart from each other in association with removal and insertion of a mating connector (9); an insulator (5) for holding the normally closed terminal (3) and the common terminal (4); a shell (6) for holding the insulator (5) from outside; and a housing (7) for holding the shell (6) from outside, a connecting portion (33) of the normally closed terminal (3), a connecting portion (43) of the common terminal (4), and a pair of connecting portions (63)(63) of the shell (6) being protruded in a horizontal direction to be placed on corresponding lands (13, 23)(14, 24)(15, 25)(15, 25) formed on a surface of a printed wiring board (1, 2) near an edge thereof, the coaxial connector (10) with a switch being mounted onto the edge of the printed wiring board (1, 2) through soldering of each connecting portion, wherein: the pair of connecting portions (63)(63) of the shell (6) are placed at horizontally symmetric positions with respect to a vertical plane (74) passing a center or nearly the center of the housing (7); the connecting portion (33) of the normally closed terminal (3) and the connecting portion (43) of the common terminal (4) are placed at horizontally symmetric positions with respect to the vertical plane (74); and a top surface and a bottom surface of each of the connecting portions (63)(63)(33)(43) are formed into vertically symmetric shapes with respect to a horizontal plane (75) passing centers or nearly the centers of the connecting portions (63)(63)(33)(43).

According to the above arrangement, the pair of connecting portions (63)(63) of the shell (6) are placed at horizontally symmetric positions with respect to the vertical plane (74) passing the center or nearly the center of the housing (7); the connecting portion (33) of the normally closed terminal (3) and the connecting portion (43) of the common terminal (4) are placed at horizontally symmetric positions with respect to the vertical plane (74); and the top surface and the bottom surface of each of the connecting portions (63)(63)(33)(43) are formed into vertically symmetric shapes with respect to the horizontal plane (75) passing the centers or nearly the centers of the connecting portions (63)(63)(33)(43). Consequently, as with the aspect of the invention in which the lands (13, 23)(14, 24)(15, 25)(15, 25) formed on the surface of the printed wiring board (1, 2) near the edge thereof are arranged inversely, the coaxial connector (10) with a switch can be mounted onto the edge of the printed wiring board (1, 2) through the reverse mounting by merely reversing the coaxial connector (10) with a switch.

Another aspect of the invention provides the coaxial connector (10) with a switch according to the aspect of the invention described above, wherein a horizontal plane passing the center or nearly the center of the housing (7) is given as the horizontal plane (75), so that the heights of the coaxial connector (10) with a switch from the main surface and from the back surface of the printed wiring board (1, 2) are made almost equal when mounted.

Another aspect of the invention provides the coaxial connector (10) with a switch according to an aspect of the invention described above, wherein: the housing (7) includes a main body portion (72) allowed to engage with two kinds of notch portions (11)(21) having different shapes formed by making a notch in the edge of the printed wiring board (1, 2); the main body (72) includes an upper main body portion (72*a*) and a lower main body portion (72*b*) partitioned vertically at the horizontal plane (75); and one of the upper main body portion (72*a*) and the lower main body portion (72*b*) is formed into a shape allowed to engage with only one of the two kinds of notch portions (11)(21), and the other is formed into a shape allowed to engage with only the other one of the two kinds of notch portions (11)(21), so that erroneous mounting can be prevented while reducing the protrusion length from the edge of the printed wiring board (1, 2) when mounted.

Another aspect of the invention provides the coaxial connector (10) with a switch according to the aspect of the invention described above, wherein: one of the two kinds of notch portions (11)(21) is formed to have an opening width of a constant value V from an opening side to an inner side, and the other is formed to have two steps having an opening width V1 (V1>V) on the opening side and an opening width V2 (V2<V) on the inner side; the lower main body portion (72*b*) is formed to have a breadth of a constant value W slightly less than V; and the upper main body portion (72*a*) is formed to have two steps having a breadth W2 (W2 takes a value slightly less than V2) on an engagement tip end side and a breadth W1 (W1 takes a value slightly less than V1) on an engagement rear end side, so that the shape of the housing (7) and the shapes of the notch portions (11)(21) can be simple.

Another aspect of the invention provides the coaxial connector (10) with a switch according to an aspect of the invention described above, wherein the housing (7) is provided with key slots (82 and 83*a* through 83*e*) allowed to engage with key protrusions provided to the mating connector (9), so that erroneous fitting with the mating connector (9) can be prevented.

BRIEF DESCRIPTION OF THE DRAWINGS

These and other objects and advantages of the present invention will become clear from the following description with reference to the accompanying drawings, wherein:

FIG. 1(*b*) is a perspective view of a coaxial connector with a switch, according to an embodiment of the present invention, showing the reverse mounting, a part of which is simplified for ease of explanation;

FIG. 2(*b*) is a front view of the coaxial connector with a switch of FIGS. 1(*a*) and 1(*b*);

FIG. 2(*c*) is a bottom view of the coaxial connector with a switch of FIGS. 1(*a*) and 1(*b*);

FIG. 7(*a*) is a front view of an insulator of FIG. 6 on a larger scale;

FIG. 7(*b*) is a left side view of FIG. 7(*a*) showing an insulator of FIG. 6 on a larger scale;

FIG. 7(*c*) is a right side view of FIG. 7(*a*) showing an insulator of FIG. 6 on a larger scale;

FIG. 8(*b*) is a cross section taken along the line 8(*b*)—8(*b*) of FIG. 7(*c*);

FIG. 8(*c*) is a cross section taken along the line 8(*c*)—8(*c*) of FIG. 7(*c*);

FIG. 9(*a*) is a plan view of a shell of FIG. 6;

FIG. 9(*b*) is a partially cutaway front view of a shell of FIG. 6;

FIG. 9(*c*) is a bottom view of a shell of FIG. 6;

FIG. 10(*a*) is a left side view of FIG. 9(*b*) of the shell of FIG. 6;

FIG. 10(*b*) is a right side view of FIG. 9(*b*) of the shell of FIG. 6;

FIG. 10(*c*) is a cross section taken along the line 10(*c*)—10(*c*) of FIG. 9(*b*) of the shell of FIG. 6;

FIG. 11(*a*) is a plan view of a housing of FIG. 6;

FIG. 11(*b*) is a front view of a housing of FIG. 6;

FIG. 11(*c*) is a bottom view of a housing of FIG. 6;

FIG. 17(*b*) is a view of the bottom surface of the product in the normal mounting of the coaxial connector with a switch onto a printed wiring board;

FIG. 17(*c*) is a view of the main surface of the board in the normal mounting of the coaxial connector with a switch onto a printed wiring board;

FIG. 17(*d*) is a view of the back surface of the board in the normal mounting of the coaxial connector with a switch onto a printed wiring board;

FIG. 17(*e*) is a view of the main surface of the product in the mounted state in the normal mounting of the coaxial connector with a switch onto a printed wiring board;

FIG. 17(*f*) is a view of the back surface of the product in the mounted state in the normal mounting of the coaxial connector with a switch onto a printed wiring board;

FIG. 18(*b*) is a view of the bottom surface of the product in the reverse mounting of the coaxial connector with a switch onto a printed wiring board;

FIG. 18(*c*) is a view of the main surface of the board in the reverse mounting of the coaxial connector with a switch onto a printed wiring board;

FIG. 18(*d*) is a view of the back surface of the board in the reverse mounting of the coaxial connector with a switch onto a printed wiring board;

FIG. 18(*e*) is a view of the main surface of the product in the mounted state in the reverse mounting of the coaxial connector with a switch onto a printed wiring board;

FIG. 18(*f*) is a view of the back surface of the product in the mounted state in the reverse mounting of the coaxial connector with a switch onto a printed wiring board;

FIG. 21(*b*) is an explanatory view of the conventional example of FIG. 21(*a*);

FIG. 22(*b*) is an explanatory view of another conventional example of FIG. 22(*a*);

DETAILED DESCRIPTION OF THE PREFERRED EMBODIMENTS

Figure 1A:
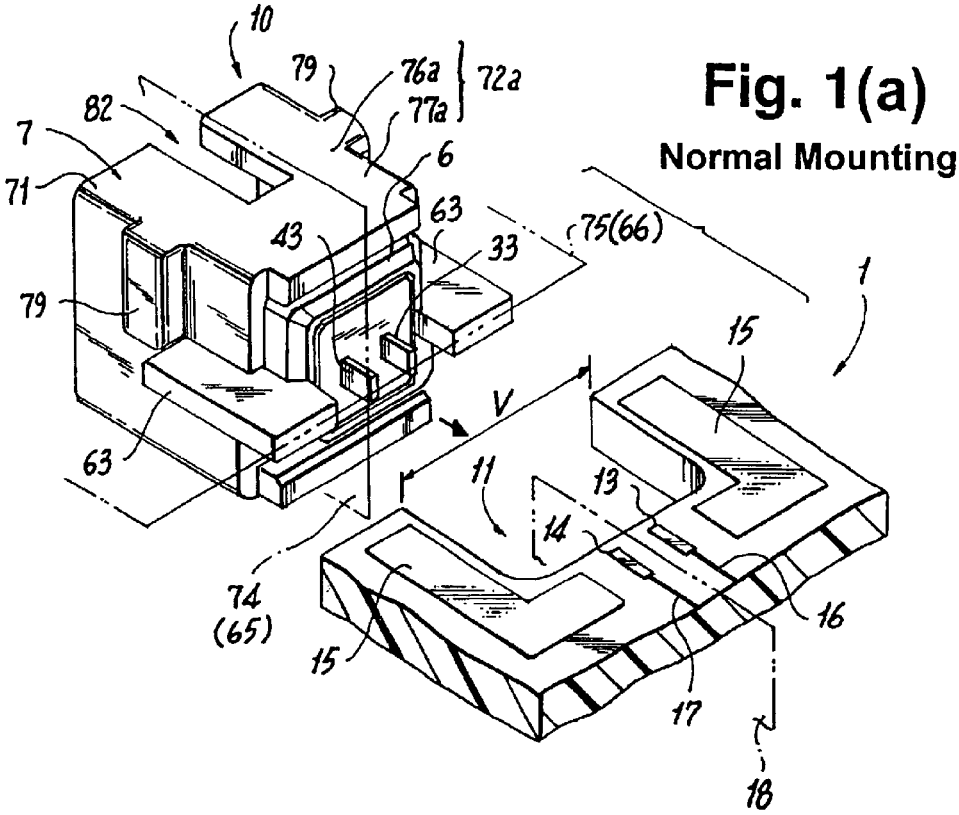
FIG. 1(*a*) is a perspective view of a coaxial connector with a switch, according to an embodiment of the present invention, showing the normal mounting, a part of which is simplified for ease of explanation.
Figure 1B:
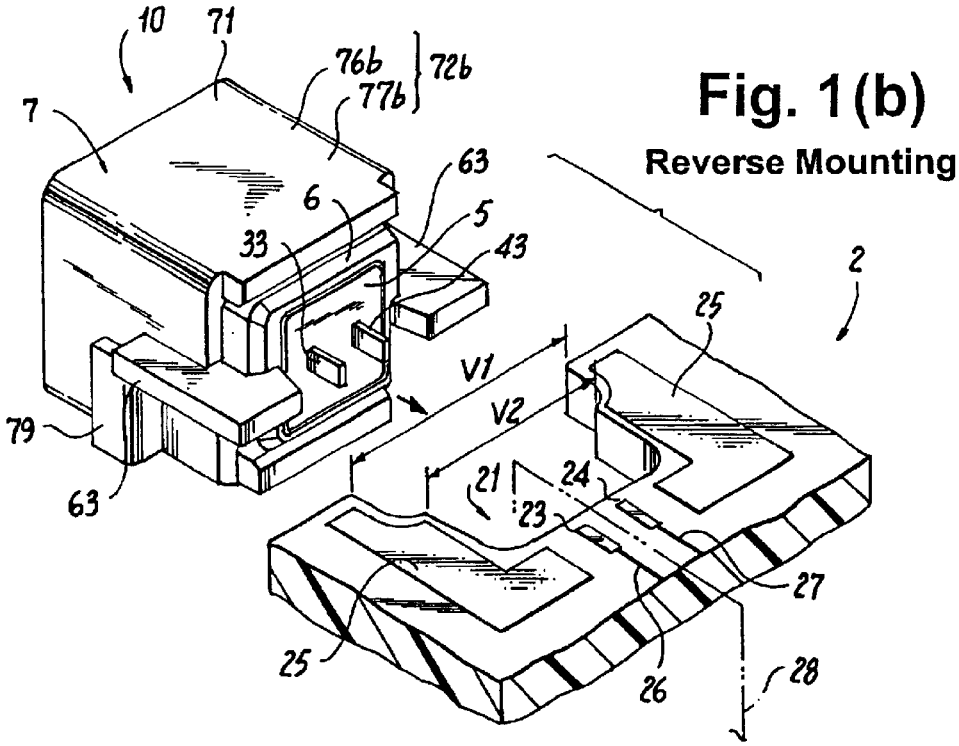
Figure 20:
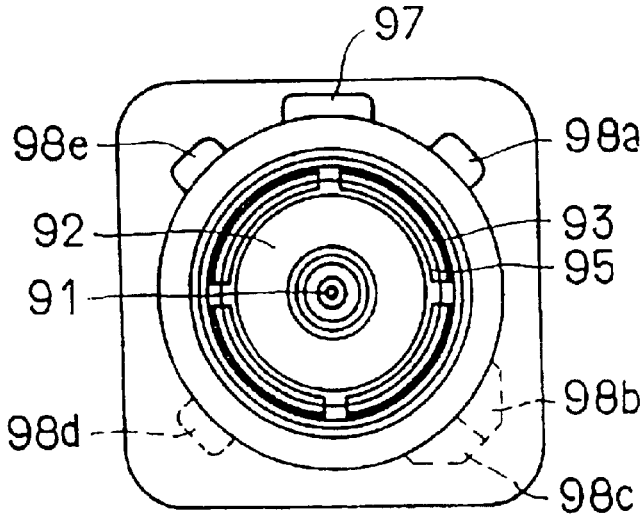
FIG. 20 is an enlarged right side view of FIG. 19.
Figure 21A:
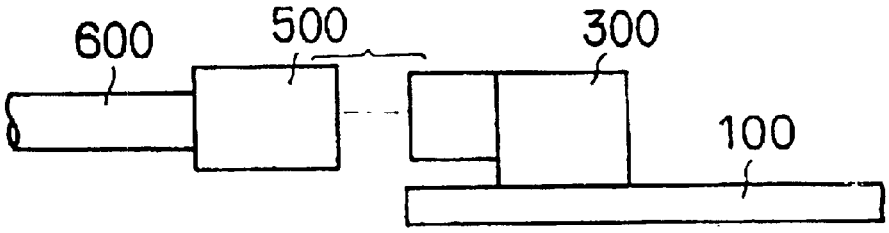
Fig. 21(a) (Prior Art)
FIG. 21(*a*) is an explanatory view of a conventional example.
Figure 21B:
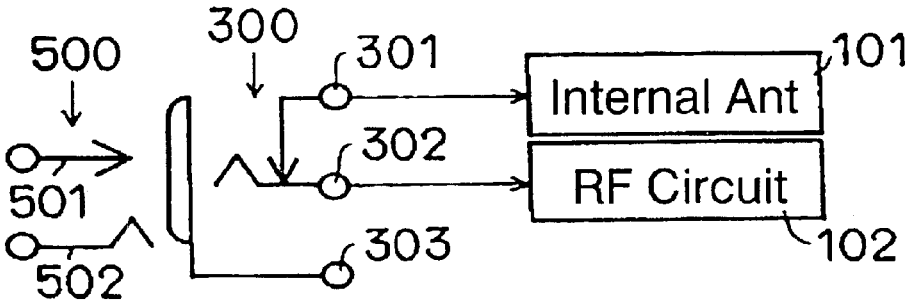
Fig. 21(b) (Prior Art)
Figure 22A:
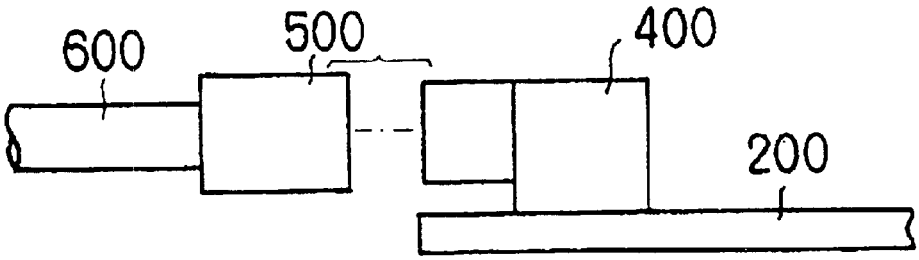
Fig. 22(a) (Prior Art)
FIG. 22(*a*) is an explanatory view of another conventional example where an internal ANT and an RF circuit are arranged inversely in comparison with the case of FIGS. 21(*a*) and 21(*b*)
Figure 22B:
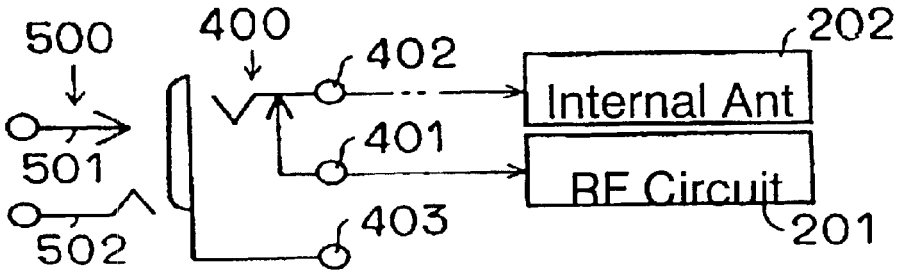
Fig. 22(b) (Prior Art)

The following description will describe one embodiment of the invention with reference to FIG. 1(*a*) through FIG. 20.

Figure 2A:
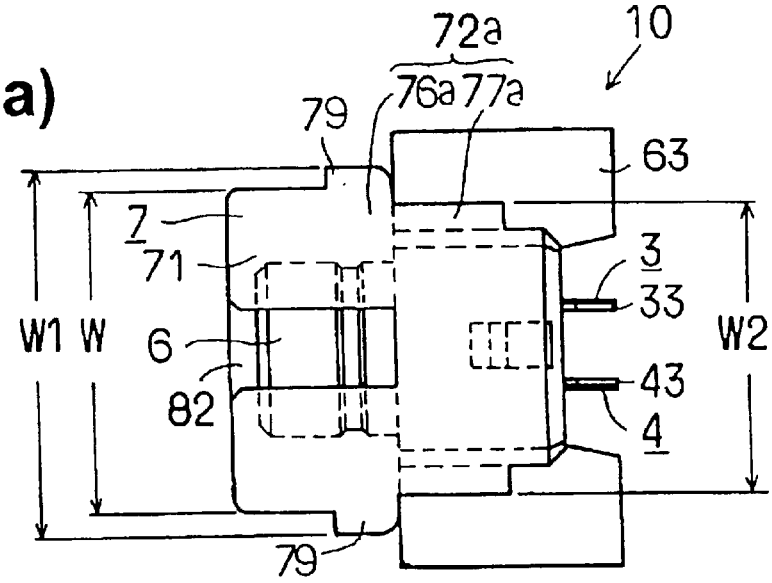
FIG. 2(*a*) is a plan view of the coaxial connector with a switch of FIGS. 1(*a*) and 1(*b*)
Figure 2B:
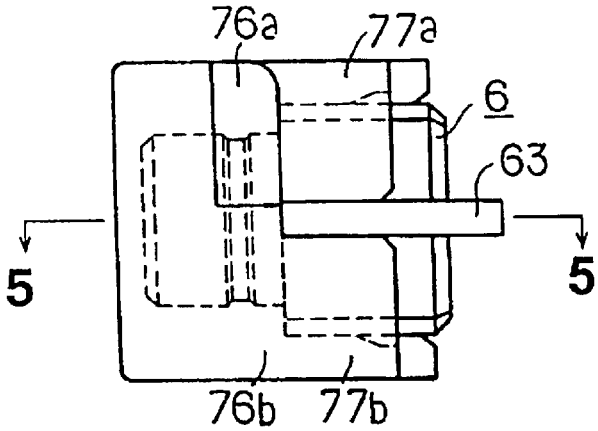
Figure 2C:
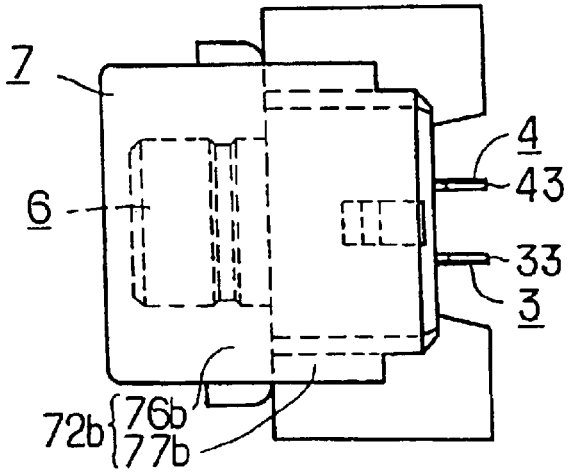
Figure 3:
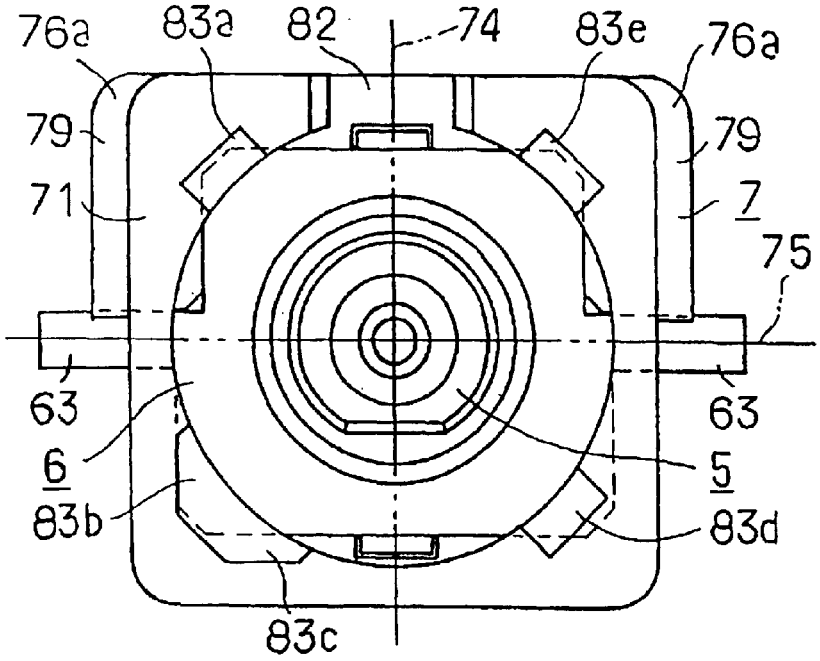
FIG. 3 is an enlarged left side view of the coaxial connector with a switch of FIG. 2(*b*)
Figure 4:
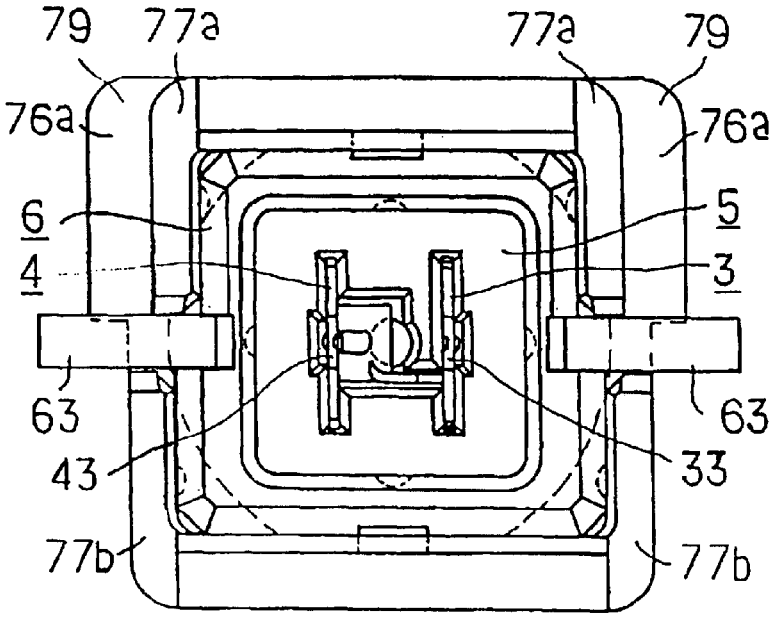
FIG. 4 is an enlarged right side view of the coaxial connector with a switch of FIG. 2(*b*)
Figure 5:
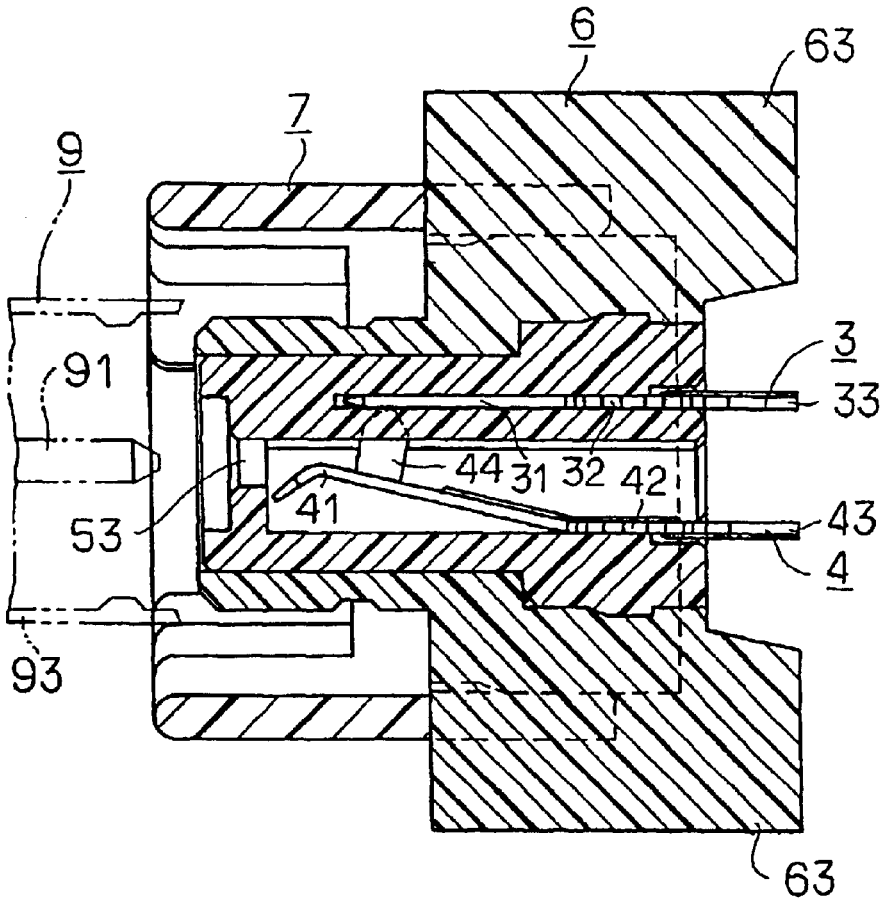
FIG. 5 is an enlarged cross section taken along the line 5—5 of FIG. 2(*b*)
Figure 6:
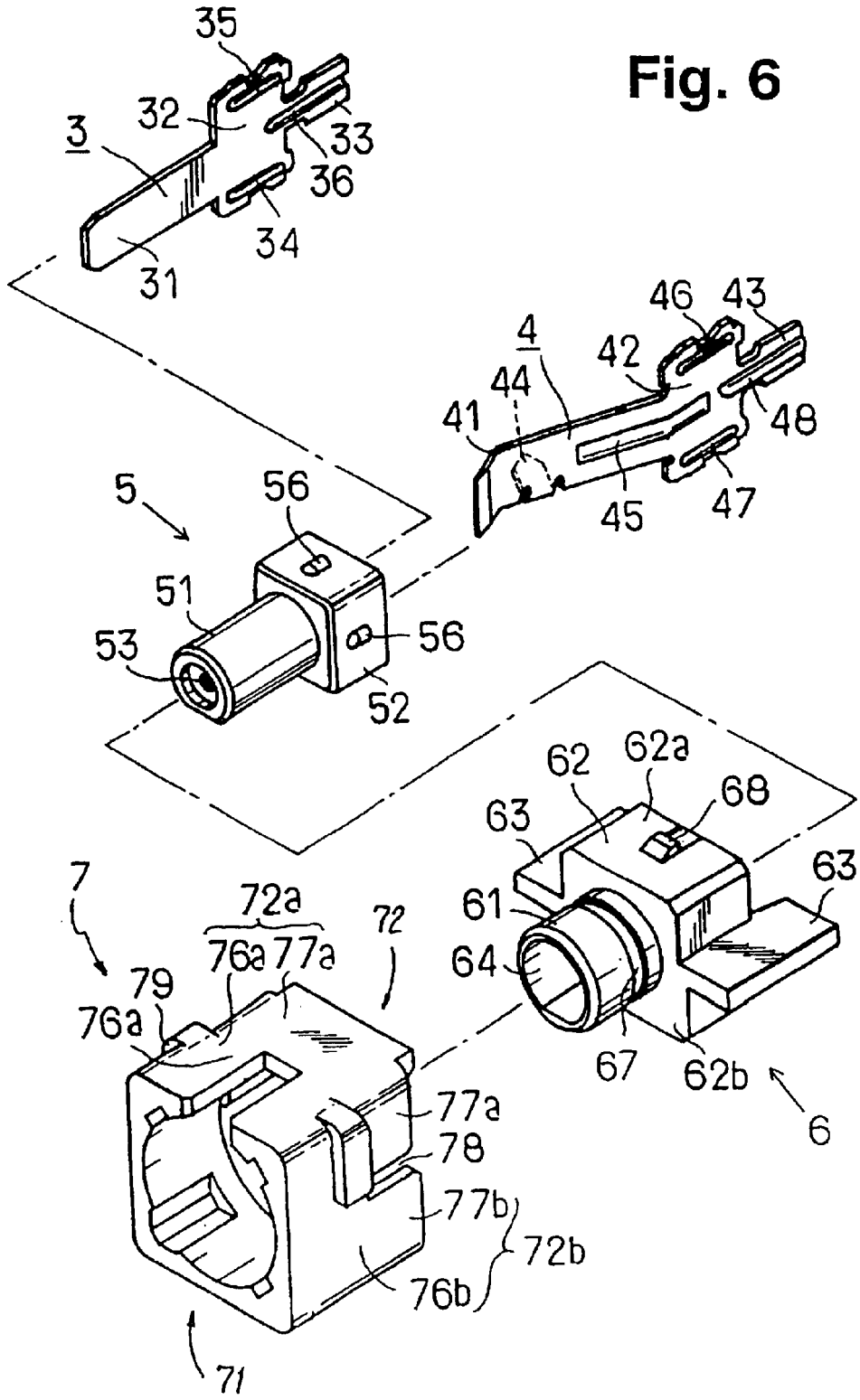
FIG. 6 is an exploded perspective view of the coaxial connector with a switch of FIGS. 1(*a*) and 1(*b*) showing two terminals on a double scale, a part of which is simplified for ease of explanation.

FIGS. 1(*a*) and 1(*b*) are perspective views of a coaxial connector with a switch when mounted through the normal mounting and the reverse mounting, respectively, a part of which is simplified for ease of explanation. FIGS. 2(*a*), 2(*b*) and 2(*c*) are a plan view, a front view, and a bottom view of the coaxial connector with a switch, respectively. FIG. 3 is an enlarged left side view of FIG. 2(*b*). FIG. 4 is an enlarged right side view of FIG. 2(*b*). FIG. 5 is an enlarged cross section taken along the line 5—5 of FIG. 2(*b*). FIG. 6 is an exploded perspective view of the coaxial connector with a switch showing two terminals on a double scale.

Referring to FIG. 1(*a*) through FIG. 6, reference numerals 1 and 2 denote a printed wiring board, and reference numeral 10 denotes a receptacle type coaxial connector with a switch (hereinafter, referred to simply as the coaxial connector with a switch).

As shown in FIG. 1(*a*), the printed wiring board 1 is provided with, at the edge thereof, a notch portion 11 of an almost rectangular shape having the opening width (length in the horizontal direction) of a constant value V from the opening side to the inner side. Lands 13 and 14 for the use of signals and lands 15 and 15 for the use of grounding are formed on the surface near the edge of the notch portion 11.

Figure 23A:
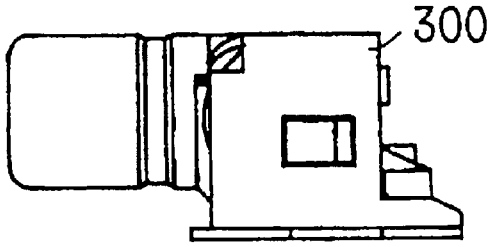
Fig. 23(a) (Prior Art)
FIGS. 23(*a*)–23(*c*) are views showing an embodiment of the conventional example of FIGS. 21(*a*) and 21(*b*)
Figure 23B:
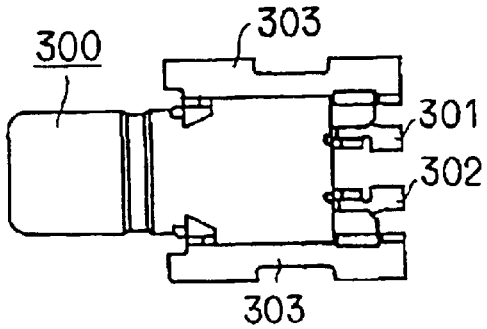
Fig. 23(b) (Prior Art)
Figure 23C:
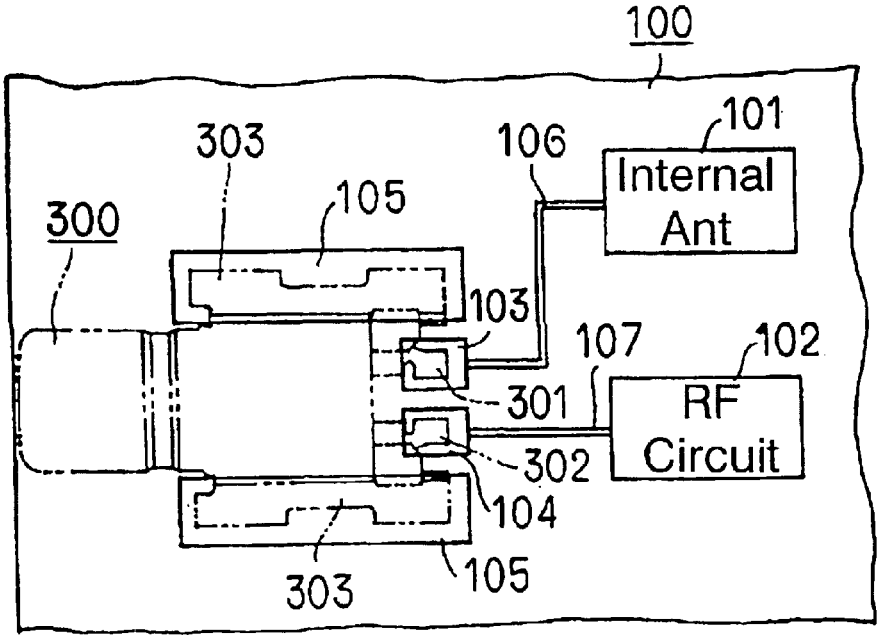
Fig. 23(c) (Prior Art)

The lands 13 and 14 for the use of signals are formed on the surface near the inner side of the notch portion 11, and placed at the horizontally symmetric positions with respect to a vertical plane 18 that divides the notch portion 11 into halves on the right and left. The surfaces thereof are formed into horizontally symmetric shapes (rectangular shapes) with respect to the vertical plane 18. The lands 13 and 14 for the use of signals are arranged in the same manner as shown in FIG. 23(*c*), so that the land 13 is connected to an internal ANT (not shown) through a wiring pattern 16 and the other land 14 is connected to an RF circuit (not shown) through a wiring pattern 17.

The lands 15 and 15 for the use of grounding are formed on the surface near the edge of the notch portion 11 from either side to the inner side, and placed at horizontally symmetric positions with respect to the vertical plane 18. The surfaces thereof are formed into horizontally symmetric shapes (shaped like a letter L and an inverted letter L) with respect to the vertical plane 18.

As shown in FIG. 1(*b*), the printed wiring board 2 is provided with, at the edge thereof, a notch portion 21 of an almost convex shape with two steps having an opening width V1 (V1>V) on the opening side and an opening with V2 (V2<V) on the inner side. Lands 23 and 24 for the use of signals and lands 25 and 25 for the use of grounding are formed on the surface near the edge of the notch portion 21.

Figure 24A:
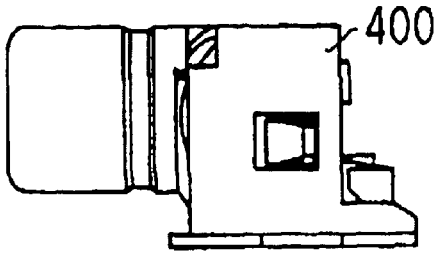
Fig. 24(a) (Prior Art)
FIGS. 24(*a*)–24(*c*) are views showing an embodiment of the conventional example of FIGS. 22(*a*) and 22(*b*).
Figure 24B:
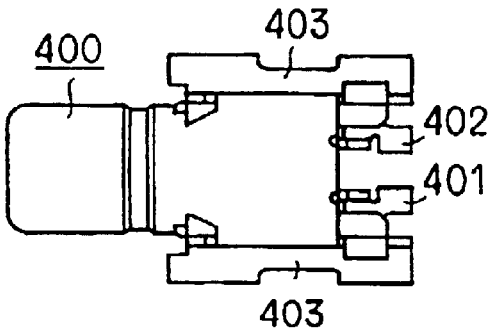
Fig. 24(b) (Prior Art)
Figure 24C:
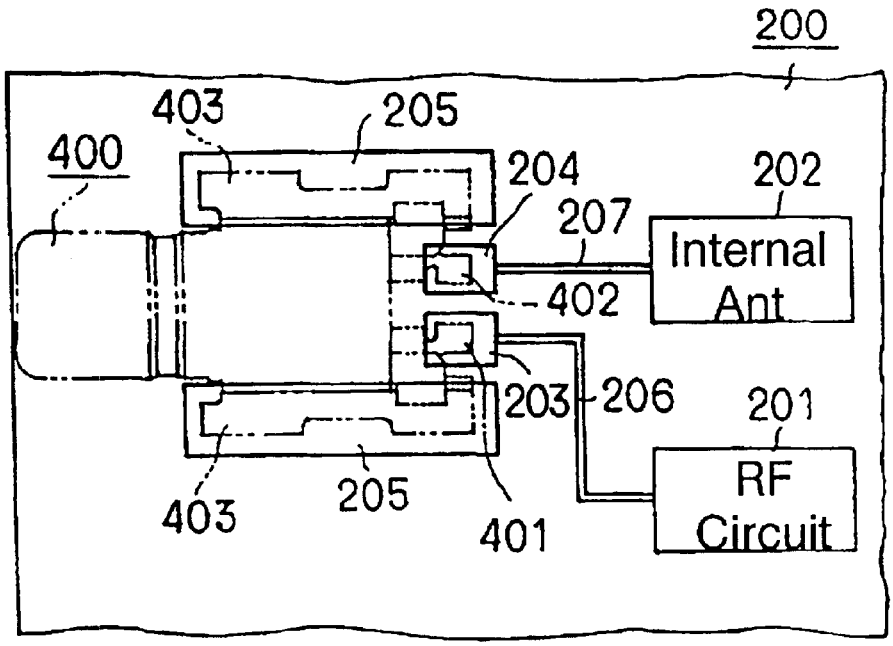
Fig. 24(c) (Prior Art)

As with the lands 13 and 14 of FIG. 1(*a*), the lands 23 and 24 for the use of signals are placed at horizontally symmetric positions with respect to a vertical plane 28 that divides the notch portion 21 into halves on the right and left. The surfaces thereof are formed into horizontally symmetric shapes (rectangular shapes) with respect to the vertical plane 28. The lands 23 and 24 for the use of signals are arranged in the same manner as shown in FIG. 24(*c*), so that the land 23 is connected to an internal ANT (not shown) through a wiring pattern 26, and the other land 24 is connected to an RF circuit (not shown) through a wiring pattern 27.

The lands 25 and 25 for the use of grounding are formed on the surface near the edge of the notch portion 21 from either side to the inner side, and placed at horizontally symmetric positions with respect to the vertical plane 28. The surfaces thereof are formed into horizontally symmetric shapes (shaped like a letter L and an inverted letter L) with respect to the vertical plane 28.

In short, the layout of the internal ANT and the RF circuit connected to the lands 23 and 24, respectively, on the printed wiring board 2 of FIG. 1(*b*) is arranged inversely with respect to the layout of the internal ANT and the RF circuit connected to the lands 13 and 14, respectively, on the printed wiring board 1 of FIG. 1(*a*).

As shown in FIG. 2(*a*) through FIG. 6, the coaxial connector 10 with a switch is composed of a normally closed terminal 3 and a common terminal 4 as a central conductor, an insulator 5 for holding the normally closed terminal 3 and the common terminal 4, a shell 6 as an external conductor for holding the insulator 5 from outside, and a housing 7 for holding the outside of the shell 6.

In the exploded perspective view of FIG. 6, the normally closed terminal 3 and the common terminal 4 are scaled up two times with respect to the insulator 5, the shell 6, and the housing 7 for ease of explanation.

The normally closed terminal 3 is formed through punching from a metal plate of copper alloy and gold plating, and as shown in FIG. 6, it includes a contact portion 31, a stopper portion 32, and a connecting portion 33, which are continuously formed as one body from the tip end side (front side of the drawing) to the rear end side. Reinforcing beads (strip-like protrusions) 34, 35, and 36 are provided to the stopper portion 32 and the connecting portion 33. The top surface and the bottom surface of the connecting portion 33 are formed into vertically symmetric shapes with respect to the horizontal plane passing the center of the connecting portion 33.

The common terminal 4 is formed through punching and folding from a metal plate of copper alloy and gold plating, and as shown in FIG. 6, it includes a first contact portion 41, a stopper portion 42, and a connecting portion 43, which are continuously formed as one body from the tip end side to the rear end side, and a second contact portion 44 which is formed continuously from the first contact portion 41 and bent at or nearly at right angles from the edge near the tip end portion. Reinforcing beads 45, 46, 47 and 48 are provided to the first contact portion 41, the stopper portion 42, and the connecting portion 43.

The connecting portion 43 is of the same shape as that of the connecting portion 33 except that the reinforcing bead 48 protrudes in a direction opposite to a direction in which the reinforcing bead 36 protrudes.

The insulator 5 is molded from a thermoplastic resin, and the outside shape thereof is formed to be almost horizontally symmetric and vertically symmetric with respect to a vertical plane 57 and a horizontal plane 58, respectively, both passing the center or nearly the center thereof.

Figure 8A:
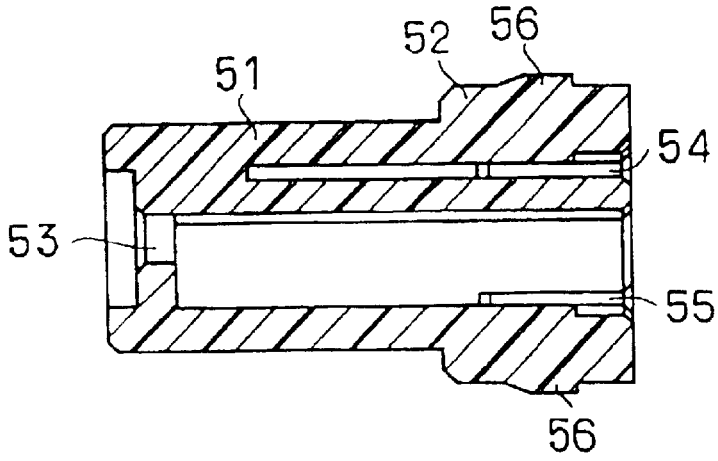
FIG. 8(*a*) is a cross section taken along the line 8(*a*)—8(*a*) of FIG. 7(*a*)
Figure 8B:
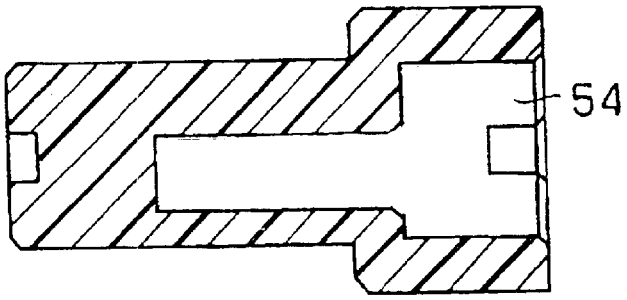
Figure 8C:
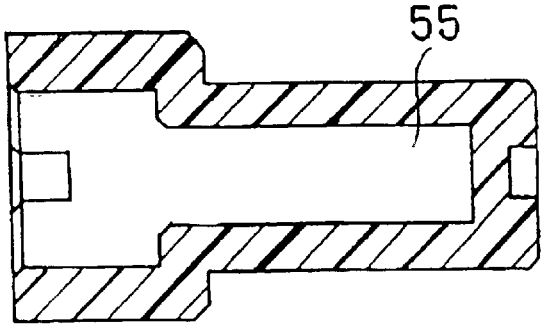
Figure 12:
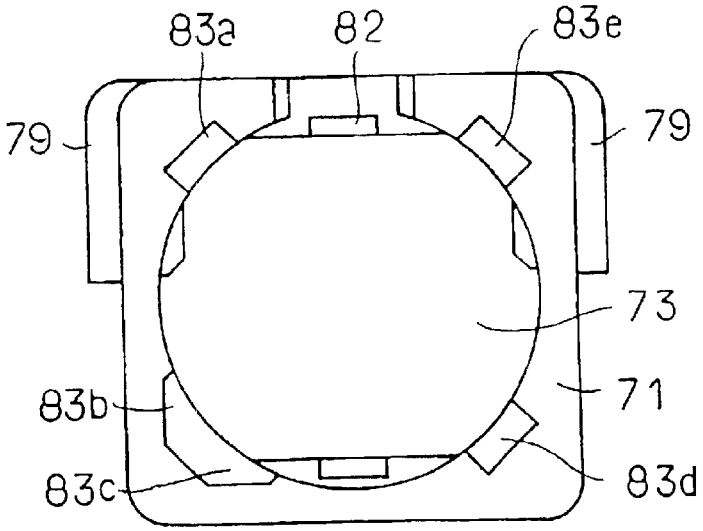
FIG. 12 is an enlarged left side view of FIG. 11(*b*)
Figure 13:
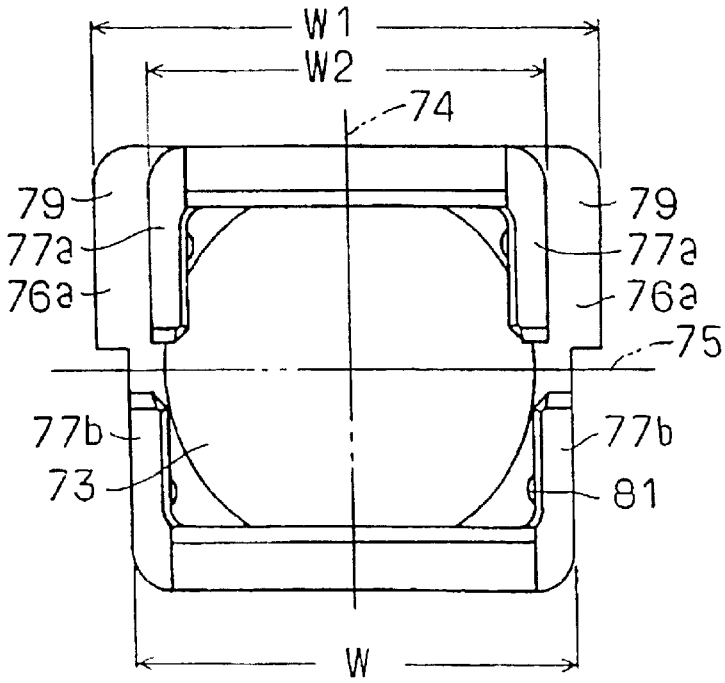
FIG. 13 is an enlarged right side view of FIG. 11(*b*)
Figure 14:
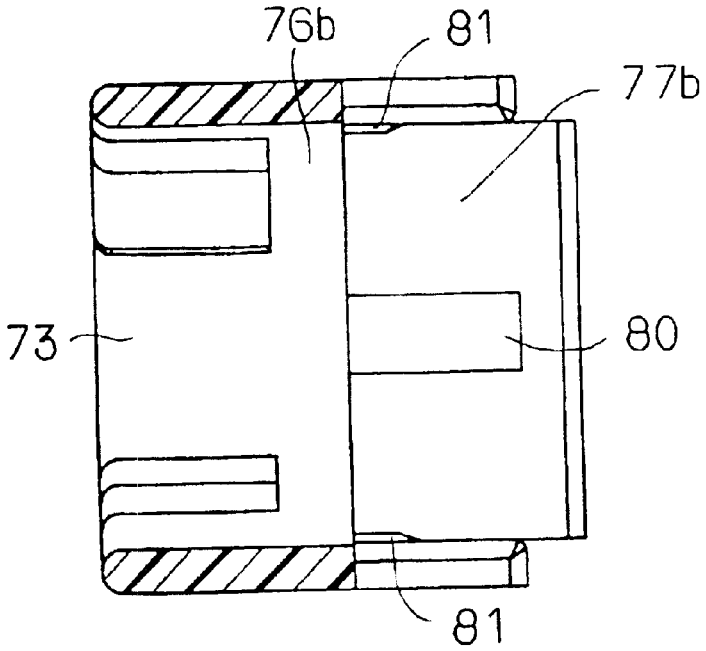
FIG. 14 is an enlarged cross section taken along the line 14—14 of FIG. 11(*b*)

As shown in FIG. 7(*a*) through FIG. 7(*c*) and FIG. 8(*a*) through FIG. 8(*c*), the insulator 5 includes a fitting portion 51 having an almost cylindrical outside shape and a holder portion 52 having an almost prismatic outside shape, which are continuously formed as one body from the tip end side (front side of FIG. 6) to the rear end side.

Through the fitting portion 51 and the holder portion 52 is provided a pin-inserting hole 53 into which a center pin 91 of a mating connector 9 (described below) is inserted.

The fitting portion 51 and the holder portion 52 are provided with terminal-accommodating slots 54 and 55 into which the normally closed terminal 3 and the common terminal 4 are press-fit for being attached, respectively. The terminal-accommodating slots 54 and 55 use the rear end sides (inner sides of FIG. 6) as insert openings. The terminal-accommodating slot 54 is on the right side when viewed from the rear end side and formed along the longitudinal direction with a part of which communicating with the pin-inserting hole 53. The other terminal-accommodating slot 55 is on the left side when viewed from the rear end side, and formed along the longitudinal direction with a part of which communicating with the pin-inserting hole 53.

A plurality of stopper protrusions 56 are provided to the outer wall surface of the holder portion 52, which are press-fit into the shell 6 for being attached.

The shell 6 is formed through die casting of aluminum or zinc alloy followed by gold plating, and as shown in FIG. 9(*a*) through FIG. 9(*c*) and FIG. 10(*a*) through FIG. 10(*c*), it includes an almost cylindrical contact portion 61 and an almost prismatic main body portion 62, which are continuously formed as one body from the fitting side (front side of FIG. 6) to the rear end side. Also, the shell 6 is provided with a pair of wing-like connecting portions 63 and 63 that protrude in the horizontal direction from the both sidewalls of the main body portion 62.

Through the contact portion 61 and the main body portion 62 is provided an insulator-fitting hole 64 into which the insulator 5 is accommodated.

The pair of connecting portions 63 and 63 are placed at horizontally symmetric positions with respect to a vertical plane 65 passing the center of the shell 6. The top surface and the bottom surface of the pair of connecting portions 63 and 63 are formed into vertically symmetric shapes with respect to a horizontal plane 66 passing the center of the shell 6.

An engagement slot 67 to be engaged with an engagement protrusion 95 of a shell 93 of the mating connector 9 is formed on the outer circumferential wall of the contact portion 61 along the circumferential direction.

The main body portion 62 is composed of an upper main body portion 62*a* and a lower main body portion 62*b* partitioned vertically into halves at the horizontal plane 66. The breadth (width in the horizontal direction, and so is defined hereinafter) of the upper main body portion 62*a* is made to be less than the breadth of the lower main body portion 62*b*.

An engagement protrusion 68 is provided to each of the top wall surface of the upper main body portion 62*a* and the bottom wall surface of the lower main body portion 62*b*.

Figure 15:
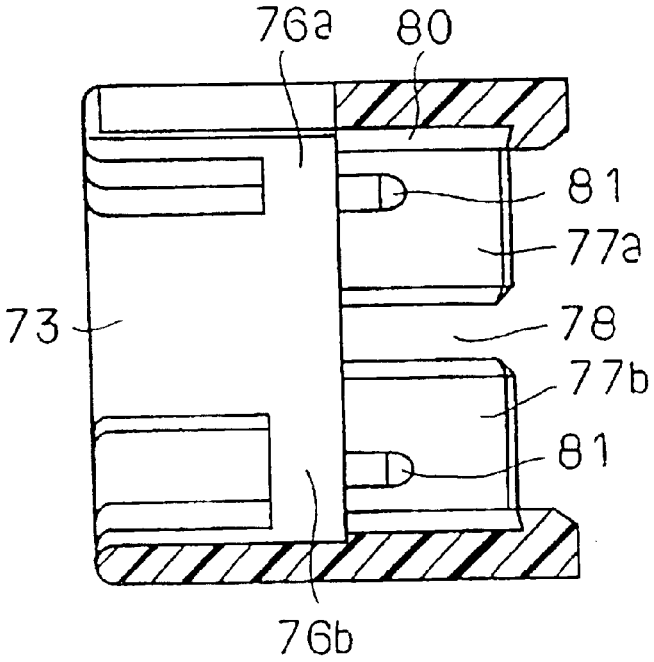
FIG. 15 is an enlarged cross section taken along the line 15—15 of FIG. 11(*a*)
Figure 16A:
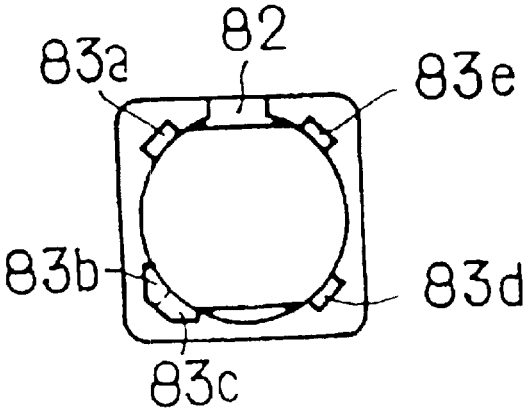
FIGS. 16(*a*)–16(*k*) are explanatory views of six key slots on the housing of FIGS. 6, and 11(*a*)–15.
Figure 16B:
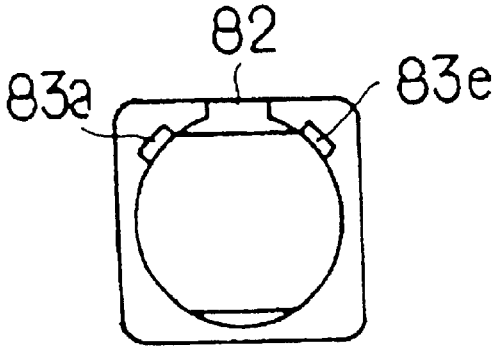
Figure 16C:
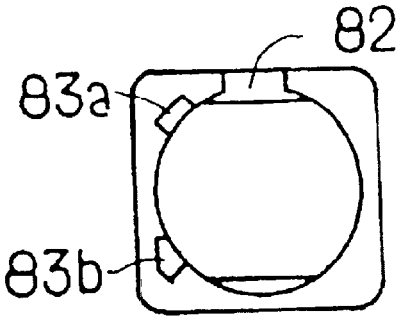
Figure 16D:
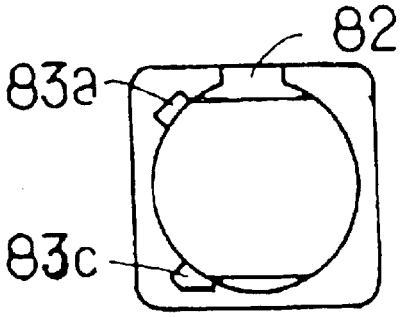
Figure 16E:
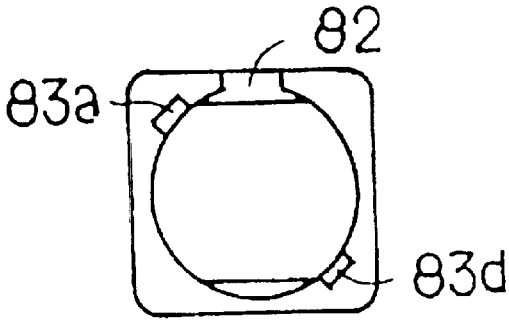
Figure 16F:
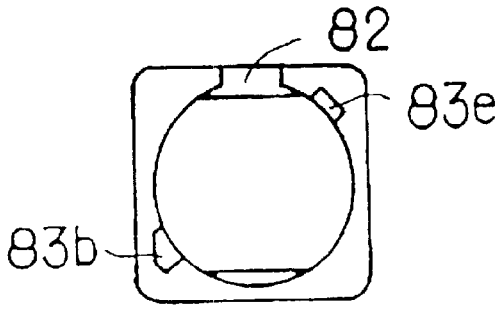
Figure 16G:
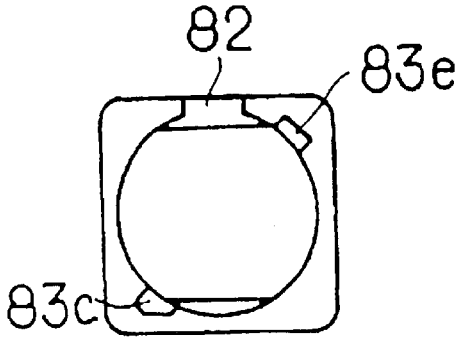
Figure 16H:
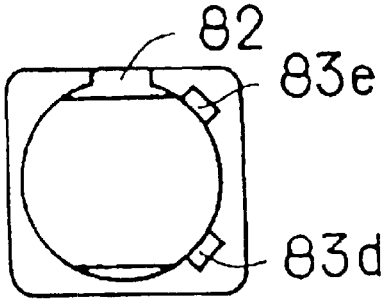
Figure 16I:
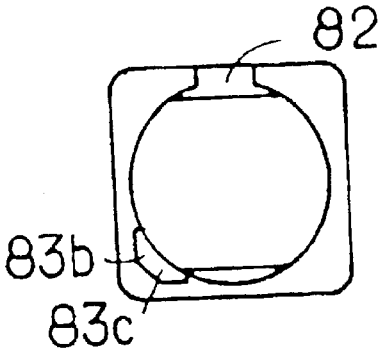
Figure 16J:
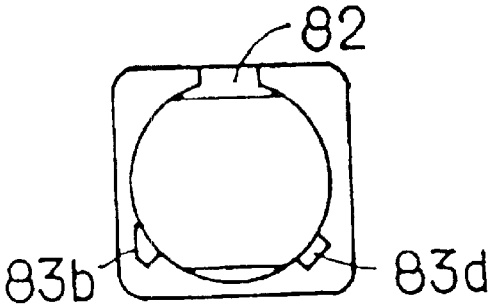
Figure 16K:
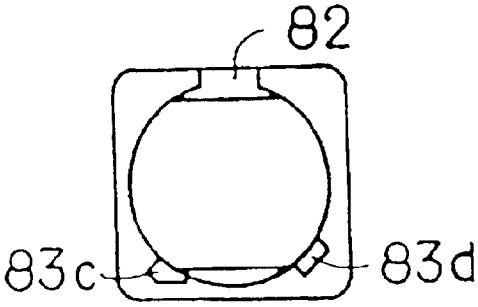
Figure 17A:
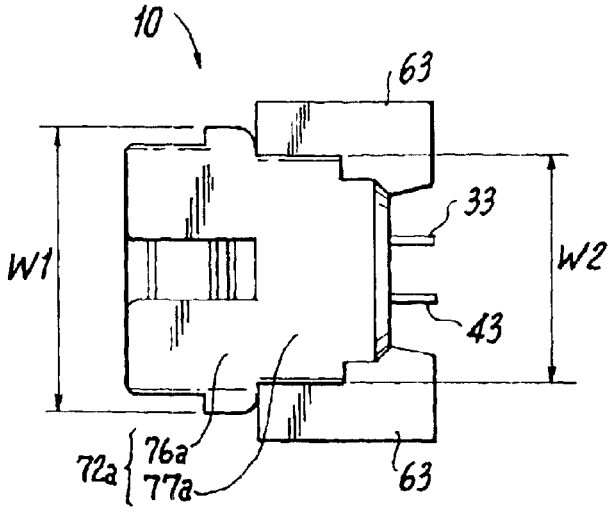
FIG. 17(*a*) is a view of the top surface of the product in the normal mounting of the coaxial connector with a switch onto a printed wiring board.
Figure 17C:
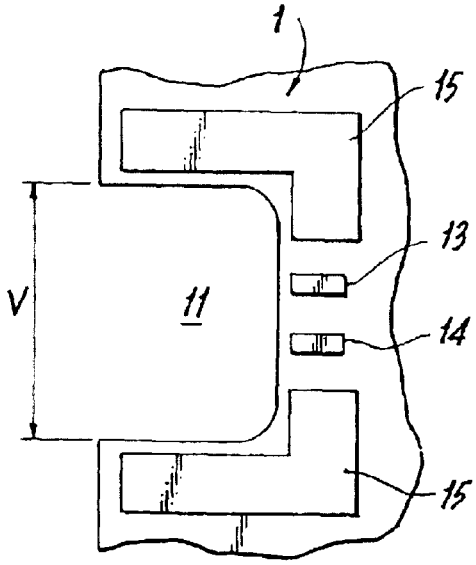
Figure 17E:
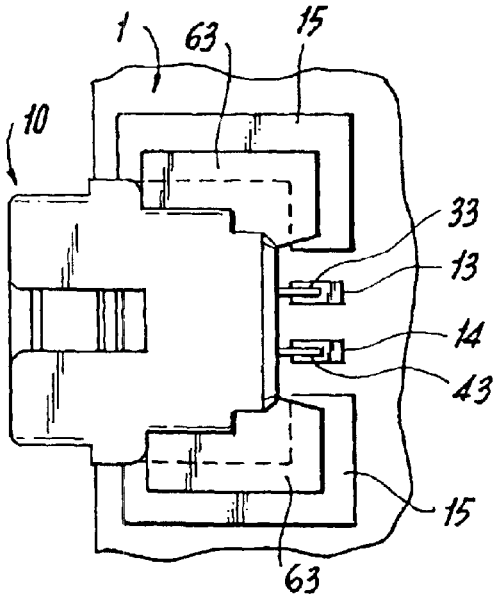
Figure 17B:
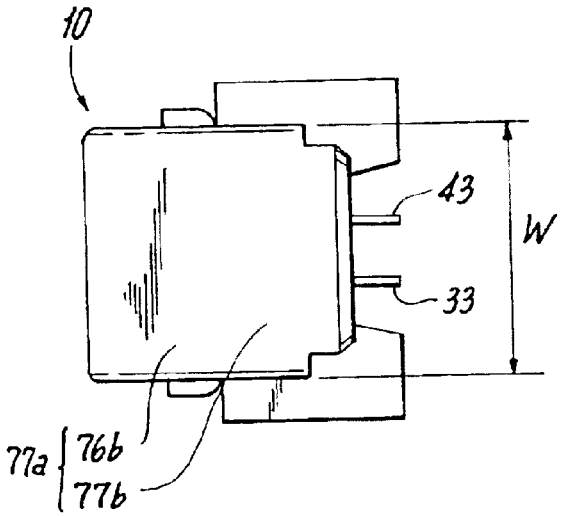
Figure 17D:
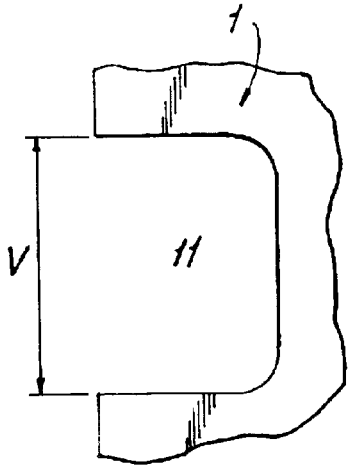
Figure 17F:
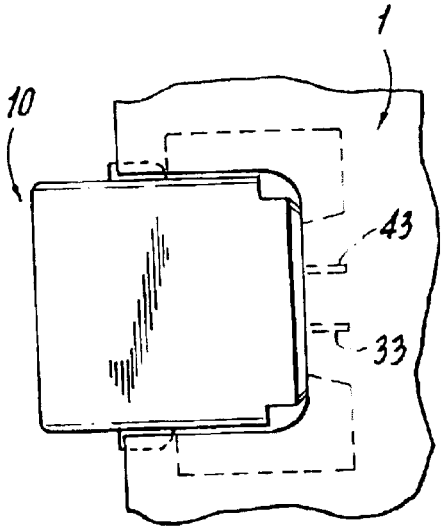
Figure 18A:
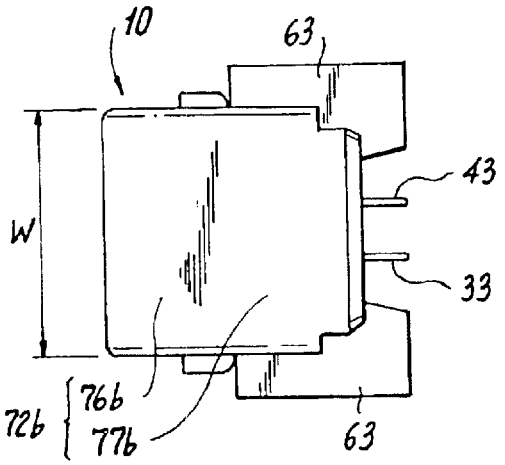
FIG. 18(*a*) is a view of the top surface of the product in the reverse mounting of the coaxial connector with a switch onto a printed wiring board.
Figure 18C:
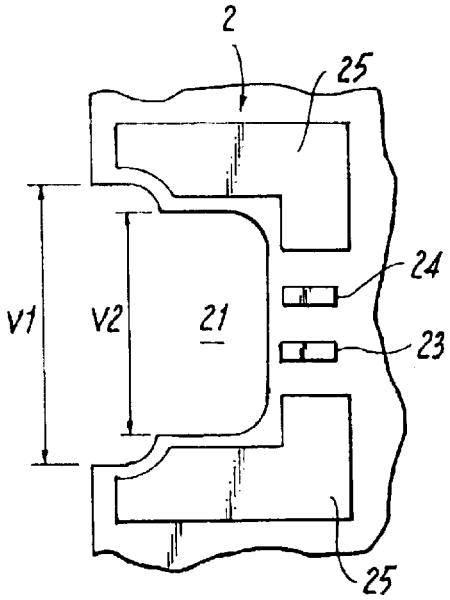
Figure 18E:
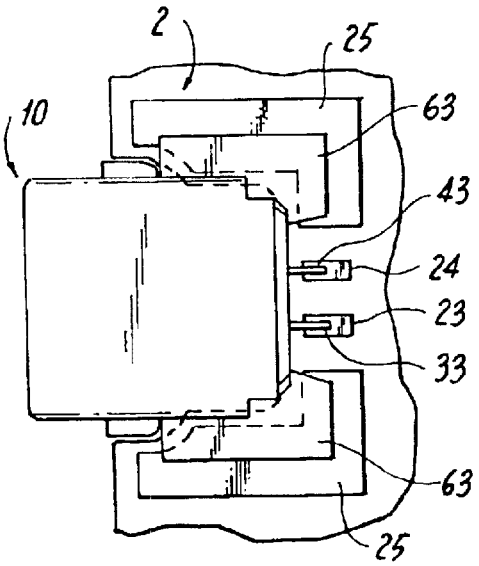
Figure 18B:
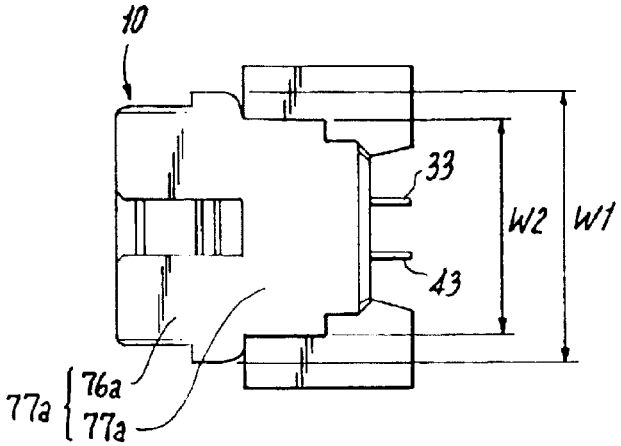
Figure 18D:
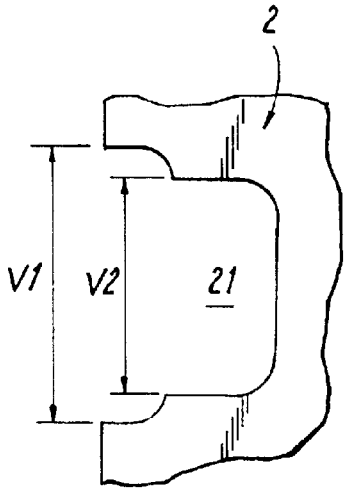
Figure 18F:
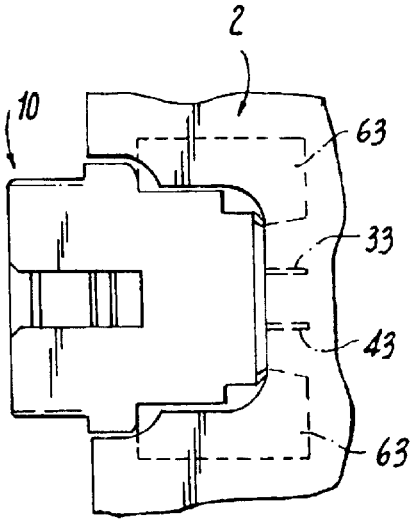

The housing 7 is molded from thermoplastic resin, and as shown in FIG. 11(*a*) through FIG. 15, it includes a tip end portion 71 and a main body portion 72, which are continuously formed as one body from the tip end side (fitting side, the front side of FIG. 6) to the rear end side.

Through the tip end portion 71 and the main body portion 72 is provided a shell-accommodating hole 73 into which not only the main body portion 62 of the shell 6 is accommodated for being held, but also a shell 92 of the mating connector 9 is accommodated on the tip end side in a space defined with the contact portion 61 of the shell 6.

The tip end portion 71 is formed into an almost symmetric shape with respect to a vertical plane 74 and a horizontal plane 75 each passing the center or nearly the center of the housing 7, and is formed into a tube-like shape having the outside contour of the cross section thereof shaped into a square with a side-length of W (a value slightly less than V), and the inner contour of the cross section thereof formed into a circular shape.

The main body portion 72 is formed into a horizontally symmetric shape with respect to the vertical plane 74, and includes an upper main body portion 72*a* and a lower main body portion 72*b* partitioned vertically into halves at the horizontal plane 75.

The upper main body portion 72*a* is composed of a first upper main body portion 76*a* on the tip end side and a second upper main body portion 77*a* on the rear end side. The lower main body portion 72*b* is composed of a first lower main body portion 76*b* on the tip end side and a second lower main body portion 77*b* on the rear end side. The second upper main body portion 77*a* and the second lower main body portion 77*b* are partitioned vertically into halves by slits 78 and 78. The slits 78 and 78 are engaged with the connecting portions 63 and 63 of the shell 6 so as to allow the connecting portions 63 and 63 to protrude outward.

Protruding portions 79 and 79 are formed on the both sidewalls of the first upper main body portion 76*a* to narrow the breadth to W1, which is slightly less than V1, so that it is allowed to engage with the opening side of the notch portion 21 while being inhibited from engaging with the notch portion 11.

The second upper main body portion 77*a* is formed to have the breadth W2, which is slightly less than V2, so that it is allowed to engage with the inner side of the notch portion 21.

The first lower main body portion 76*b* and the second lower main body portion 77*b* are formed to have the breadth W, which is the same as the breadth of the tip end portion 71, so that they are allowed to engage with the notch portion 11 while being inhibited from engaging with the inner side of the notch portion 21.

An engagement slot 80 is formed on the rear end side of the upper inner wall surface of the second upper main body portion 77*a*, which abuts against the engagement protrusion 68 of the upper main body portion 62*a* of the shell 6. Also, an engagement slot 80 is formed on the rear end side of the lower inner wall surface of the second lower main body portion 77*b*, which abuts against the engagement protrusion 68 of the lower main body portion 62*b* of the shell 6.

Stopper protrusions 81 and 81 are formed to protrude from the inner wall surfaces on the tip end side of the second upper main body portion 77*a* and the second lower main body 77*b*, respectively, which abut against the corresponding outer wall surfaces of the respective upper main body portion 62*a* and lower main body portion 62*b* when the shell 6 is press-fit.

Six key slots 82 and 83*a* through 83*e*, each using the tip end side (fitting side) as the inserting side, are formed in the tip end portion 71, and the inner wall surfaces of the first upper main body portion 76*a* and the first lower main body portion 76*b* of the housing 7. These key slots 82 and 83*a* through 83*e* are provided in correspondence with key protrusions 97 and 98*a* through 98*e* (described below) provided to protrude from the housing of the mating connector 9, and prevent erroneous fitting with an inappropriate mating connector (for example, erroneous fitting with a product of any other manufacturer).

With reference to FIGS. 3, 5, 6, 12, 14, and 15, the above description described the case where all the six key slots 82 and 83*a* through 83*e* are formed as shown in FIG. 16(*a*) for ease of explanation. It should be appreciated, however, that, in practical applications, one key slot 82 is combined with any two key slots out of the five key slots 83*a* through 83*e* as shown in FIGS. 16(*b*) through 16(*k*). An arbitrary combination is selected from ten types shown in FIGS. 16(*b*) through 16(*k*), and the corresponding type is selected from ten types of the key protrusions 97 and 98*a* through 98*e* of the mating connector 9.

A method of fabricating the coaxial connector 10 with a switch will now be explained with reference to FIG. 6.

Initially, the insulator 5 is press-fit into the insulator-fitting hole 64 of the shell 6 from the rear end side (inner side of FIG. 6). In this instance, the stopper protrusions 56 of the insulator 5 abut against the inner wall of the insulator-fitting hole 64, and the insulator 5 is thereby held by the shell 6. Also, the shell 6 and the insulator 5 are assembled in such a manner that the vertical plane 65 and horizontal plane 66 of the shell 6 coincide with the vertical plane 57 and the horizontal plane 58 of the insulator 5, respectively.

Then, the normally closed terminal 3 and the common terminal 4 are press-fit respectively into the terminal-accommodating slots 54 and 55 of the insulator 5 from the rear end side. In this instance, the contact portion 31 and the stopper protrusion of the stopper portion 42 abut against the inner walls of the terminal-accommodating slots 54 and 55, respectively, and the normally closed terminal 3 and the common terminal 4 are thereby held by the insulator 5. Also, it is arranged in such a manner that the horizontal plane passing the centers of the connecting portion 33 and the connecting portion 43 coincides with the horizontal plane 58 of the insulator 5.

Then, the housing 7 is press-fit from the tip end side of the shell 6 so as to cover the shell 6, and the shell 6 is thereby accommodated inside the shell-accommodating hole 73. In this instance, the connecting portions 63 and 63 of the shell 6 protrude in the horizontal direction through the slits 78 and 78 of the housing 7. Also, the engagement protrusions 68 and 68 provided to the main body portion 62 of the shell 6 are engaged with the engagement slots 80 and 80 of the housing 7. Meanwhile, the plurality of stopper protrusions 81 protruding from the inner wall surface of the lower main body portion 72*b* abut against the outer wall of the main body portion 62 of the shell 6, and the shell 6 is thereby held by the housing 7. Also, the shell 6 and the housing 7 are assembled in such a manner that the vertical plane 74 and the horizontal plane 75 of the housing 7 coincide with the vertical plane 65 and the horizontal plane 66 of the shell 6, respectively.

A method of mounting the coaxial connector 10 with a switch onto the printed wiring boards 1 and 2 will now be explained with reference to FIG. 17(*a*) through FIG. 17(*f*) and FIGS. 18(*a*) through 18(*f*).

Initially, an explanation will be given to the normal mounting to mount the coaxial connector 10 with a switch onto the printed wiring board 1 through the engagement with the notch portion 11 with reference to FIG. 17(*a*) through FIG. 17(*f*).

(1) As shown in FIGS. 17(*a*) through 17(*d*), the lower main body portion 72*b* (76*b* and 77*b*) of the main body portion 72 of the coaxial connector 10 with a switch, which will be engaged with the notch portion 11 of the printed wiring board 1, is formed to have the breadth W slightly less than the opening width V of the notch portion 11. Hence, as shown in FIGS. 17(*e*) and 17(*f*), the coaxial connector 10 with a switch is allowed to engage with the notch portion 11 of the printed wiring board 1.

(2) Subsequently, the mounting is completed by connecting the connecting portion 33 of the normally closed terminal 3 and the connecting portion 43 of the common terminal 4 to the lands 13 and 14 for the use of signals, respectively, through soldering or the like, and by connecting the connecting portions 63 and 63 of the shell 6 to the lands 15 and 15 for the use of grounding, respectively, through soldering or the like. Consequently, the connecting portion 33 of the normally closed terminal 3 and the connecting portion 43 of the common terminal 4 are connected respectively to the internal ANT and the RF circuit on the printed wiring board 1.

(3) The coaxial connector 10 with a switch is prevented from being mounted inversely onto the printed wiring board 1 through an erroneous engagement with the notch portion 11. To be more specific, when an attempt is made to engage the coaxial connector 10 with a switch with the notch portion 11 of the printed wiring board 1 in inversed states from those shown in FIGS. 17(*a*) and 17(*b*), the upper main body portion 72*a* (76*a* and 77*a*) of the coaxial connector 10 with a switch is to engage with the notch portion 11. However, because the breadth W1 of the upper main body portion 76*a* is greater than the opening width V of the notch portion 11, it is impossible for the upper main body portion 76*a* to engage with the notch portion 11, and erroneous mounting can be thus prevented.

Next, an explanation will be given to the reverse mounting to mount the coaxial connector 10 with a switch onto the printed wiring board 2 through the engagement with the notch portion 21 with reference to FIG. 18(*a*) through FIG. 18(*f*).

(1) As shown in FIGS. 18(*a*) through 18(*d*), the upper main body portions 76*a* and 77*a* of the main body portion 72 of the coaxial connector 10 with a switch, which will be engaged with the notch portion 21 of the printed wiring board 2, are formed to have the breadths W1 and W2 slightly less than the opening widths V1 and V2 of the notch portions 21, respectively. Hence, as shown in FIGS. 18(*e*) and 18(*f*), the coaxial connector 10 with a switch is allowed to engage with the notch portion 21 of the printed wiring board 2.

(2) Subsequently, the mounting is completed by connecting the connecting portion 33 of the normally closed terminal 3 and the connecting portion 43 of the common terminal 4 to the lands 23 and 24 for the use of signals, respectively, through soldering or the like, and by connecting the connecting portions 63 and 63 of the shell 6 to the lands 25 and 25 for the use of grounding, respectively, through soldering or the like. Consequently, even in a case (the case shown in FIGS. 18(*a*) through 18(*f*)) where the layout of the internal ANT and the RF circuit is reversed to that in FIG. 17(*a*) through FIG. 17(*f*), the connecting portion 33 of the normally closed terminal 3 and the connecting portion 43 of the common terminal 4 can be connected to the internal ANT and the RF circuit on the printed wiring board 2, respectively.

(3) The coaxial connector 10 with a switch is prevented from being mounted inversely onto the printed wiring board 2 through an erroneous engagement with the notch portion 21.

To be more specific, when an attempt is made to engage the coaxial connector 10 with a switch with the notch portion 21 of the printed wiring board 2 in inversed states from those shown in FIGS. 18(*a*) and 18(*b*), the lower main body portions 76*b* and 77*b* of the main body portion 72 are to engage with the notch portion 21. However, because the breadth W thereof is greater than the opening width V2 of the notch portion 21, it is impossible for the second lower main body 77*b* of the main body portion 72 to engage with the notch portion 21, and erroneous mounting can be thus prevented.

Connection with the mating connector 9 will now be explained with reference to FIG. 19 and FIG. 20.

Figure 19:
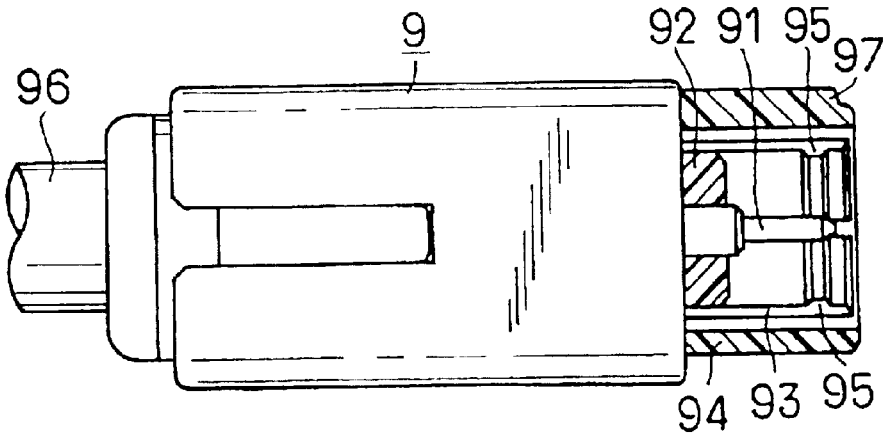
FIG. 19 is a partially cutaway front view of a mating connector.

FIG. 19 and FIG. 20 show the mating connector 9, and the mating connector 9 includes a center pin 91 as a central conductor, an insulator 92 for holding the center pin 91, a shell 93 as an external conductor for holding the insulator 92 from outside, and a housing 94 for holding the shell 93 from outside. A plurality of ¼-arc engagement protrusions 95 are provided to the inner wall surface on the fitting side of the shell 93 along the inner circumferential direction.

A coaxial cable 96 is coupled to the non-fitting side of the mating connector 9, and the central conductor of the coaxial cable 96 is electrically connected to the center pin 91, whereas the exterior conductor (for example, a braided conductor) of the coaxial cable 96 is electrically connected to the shell 93.

Assume that the key slot 82 and the key slots 83*a* and 83*e* (corresponds to FIG. 16(*b*)) are the key slots provided to the coaxial connector 10 with a switch for ease of explanation. Then, of the six key protrusions 97 and 98*a* through 98*e*, the key protrusions correspondingly provided to the mating connector 9 are one key protrusion 97 and two key protrusions 98*a* and 98*e* selected from the five key protrusions 98*a* through 98*e*, as shown in FIG. 20.

It should be noted, however, that, in practical applications, ten types including types of "97 and 98*a* and 98*e*" through "97 and 98*c* and 98*d*" are available as combinations of the key protrusions 97 and 98*a* through 98*e* provided to the mating connector 9 in correspondence with the ten types shown in FIG. 16(*b*) through FIG. 16(*k*).

When the mating connector 9 is fit into the coaxial connector 10 with a switch, the center pin 91 is inserted into the pin-inserting hole 53 and comes in elastic contact with the first contact portion 41 of the common terminal 4, which causes the first contact portion 41 to displace in a specific direction (downward of FIG. 5), whereupon the second contract portion 44 having been in contact with the contact portion 31 of the normally closed terminal 3 moves away from the contact portion 31. In short, the center pin 91 of the mating connector 9 is electrically connected to the common terminal 4, and the electrical connection between the common terminal 4 and the normally closed terminal 3 is cut off.

Also, when the mating connector 9 is fit into the coaxial connector 10 with a switch, the contact portion of the shell 93 comes in elastic contact with the contact portion 61 of the shell 6, while the engagement protrusions 95 of the shell 93 engage with the engagement slot 67 of the shell 6. In short, the shell 93 of the mating connector 9 is electrically connected to the shell 6 of the coaxial connector 10 with a switch.

Consequently, the connection of the common terminal 4 of the coaxial connector 10 with a switch is switched from the normally closed terminal 3 to the center pin 91 of the mating connector 9, and the shell 6 of the coaxial connector 10 with a switch is connected to the shell 93 of the mating connector 9. To be more specific, the RF circuit on the printed wiring board 1 or 2 is switched from the internal ANT to the external ANT.

The embodiment above described a case where the key slots 82 and 83*a* through 83*e* are provided to the housing 7 to prevent erroneous fitting with the mating contact 9. It should be appreciated, however, that the invention is not limited to such a case, and can be used in a case where the key slots 82 and 83*a* through 83*e* are omitted.

In the embodiment above, in order to form the housing 7 and the notch portions 11 and 21 into simple shapes, the main body portion 72 of the housing 7 is composed of the upper main body portion 72*a* and the lower main body portion 72*b*, the upper main body portion 72*a* and the lower main body portion 72*b* are composed of the first upper main body portion 76*a* and the second upper main body portion 77*a*, and the first lower main body portion 76*b* and the second lower main body portion 77*b*, respectively. Then W1 (W1>W) is given as the breadth of the first upper main body portion 76*a*, W2 (W2<W) as the breadth of the second upper main body portion 77*a*, and W as the breadths of the first lower main body portion 76*b* and the second lower main body portion 77*b*, so that, of the notch portion 11 and the notch portion 21, the lower main body portion 72*b* (76*b* and 77*b*) of the main body portion 72 is allowed to engage with only the notch portion 11, and the upper main body portion 72*a* (76*a* and 77*a*) is allowed to engage with only the other notch portion 21. It should be appreciated, however, that the invention is not limited to the foregoing shapes. The invention can be used in a case where the main body portion 72 includes an upper main body portion and a lower main body portion partitioned vertically at the horizontal plane 75, and one of the upper main body portion and the lower main body portion (for example, the lower main body portion) is formed into a shape such that can engage with only one of two kinds of notch portions having different shapes, while the other (for example, the upper main body portion) is formed into a shape such that can engage with the other one of the two kinds of notch portions.

The embodiment above described a case where, in order to prevent erroneous mounting while reducing the protrusion length from the edge of the printed wiring board 1 or 2 when mounted, the main body portion 72 is composed of the upper main body portion and the lower main body portion having different shapes, and one of them is formed into a shape such that can engage with only one of two kinds of notch portions having different shapes and the other is formed into a shape such that can engage with only the other one of the two kinds of notch portions. It should be appreciated, however, that the invention is not limited to such a case.

For example, the invention can be used in a case where the upper main body portion 72*a* and the lower main body portion 72*b* are formed into the same shape (for example, a rectangle with a breadth of W), or the upper portion and the lower portion of the housing 7 are formed into the same shape. In these cases, the coaxial connector 10 with a switch can be mounted onto the printed wiring boards 1 and 2 respectively having the notch portions 11 and 21 of the same shape (for example, a rectangular shape). Alternatively, the coaxial connector 10 with a switch can be mounted onto the edge of the printed wiring board 1 or 2 omitting the notch portion 11 or 21. In this instance, erroneous mounting can be prevented by providing a mark used to distinguish the top from the bottom in one of the top surface and the bottom surface of the housing 7.

The embodiment above described a case where a horizontal plane passing the center or nearly the center of the housing 7 is given as the horizontal plane 75 in order to make the heights of the coaxial connector 10 with a switch from the main surface and from the back surface of the printed wiring board 1 or 2 almost equal when mounted. It should be appreciated, however, that the invention is not limited to such a case. The invention can be used in a case where the horizontal plane 75 that partitions the top surface and the bottom surface of each of the connecting portions 63 and 63 of the shell 6, the connecting portion 33 of the normally closed terminal 3, and the connecting portion 43 of the common terminal 4 into vertically symmetric shapes is a horizontal plane passing any given point within the housing 7 other than the center of the housing 7.

The embodiment above described a case where the coaxial connector 10 with a switch includes the housing 7 that holds the outside of the shell 6, and by devising the outside shape of the housing 7, mounting through an erroneous engagement with the notch portion 11 or 21 can be prevented while reducing the protrusion length from the edge of the printed wiring board 1 or 2 when mounted. It should be appreciated, however, that the invention is not limited to such a case. The same advantage can be achieved with a coaxial connector with a switch omitting the housing 7 by devising the outside shape of the shell 6. The following description will describe more in detail such a case.

By giving the same outside shape of the housing 7 to the outside shapes of the upper main body 62*a* and the lower main body 62*b* of the shell 6 partitioned vertically at the horizontal plane 66, it is possible to prevent mounting through an erroneous engagement with the notch portion 11 or 21. To be more specific, one of the upper main body portion 62*a* and the lower main body portion 62*b* (for example, the lower main body portion 62*b*) is formed into a shape such that can engage with only one of the notch portions 11 and 21 (for example, the notch portion 11), and the other (for example, the upper main body portion 62*a*) is formed into a shape such that can engage with only the other one of the notch portions 11 and 21 (for example, the notch portion 21). Then, it becomes possible to prevent mounting through an erroneous engagement with the notch portion 11 or 21 while reducing the protrusion length from the edge of the printed wiring board 1 or 2.

In this case, given W as the breadth of the lower main body portion 62*b*, then, by forming the upper main body portion 62*a* to have two steps with W2 given as the breadth on the engagement tip end side and W1 as the breadth on the engagement rear end side, it is possible to form the shell 6 and the notch portions 11 and 21 into simple shapes.

Also, by giving a horizontal plane passing the center of the shell 6 as the horizontal plane 66 that partitions the shell 6 into the upper main body portion 62*a* and the lower main body portion 62*b*, it is possible to make the heights of a coaxial connector with a switch from the main surface and from the back surface of the printed wiring board 1 or 2 almost equal when mounted, as with the case where the housing 7 is provided. In this case, the invention can be used when a horizontal plane passing any given point within the shell 6 other than the center of the shell 6 is given as the horizontal plane 66.

Further, the invention can be used in a case where the upper main body portion 62*a* and the lower main body portion 62*b* of the shell 6 partitioned vertically at the horizontal plane 66 are formed into the same outside shape (for example, a rectangle with a breadth of W). In this case, the coaxial connector with a switch can be mounted onto the printed wiring board 1 or 2 having the notch portion 11 or 21 of the same shape (for example, a rectangle having an opening width of V). Alternatively, the coaxial connector with a switch can be mounted onto the printed wiring board 1 or 2 omitting the notch portion 11 or 21.

While there has been described what are at present considered to be preferred embodiments of the present invention, it will be understood that various modifications may be made thereto, and it is intended that the appended claims cover all such modifications as fall within the true spirit and scope of the invention.

According to an aspect of the invention, the coaxial connector 10 with a switch includes the normally closed terminal 3, the common terminal 4, the insulator 5, and the shell 6. The coaxial connector 10 with a switch is mounted on the edge of the printed wiring board 1, 2, wherein the pair of connecting portions 63 and 63 of the shell 6 are placed at horizontally symmetric positions with respect to the vertical plane 65 passing the center or nearly the center of the shell 6; the connecting portion 33 of the normally closed terminal 3 and the connecting portion 43 of the common terminal 4 are placed at horizontally symmetric positions with respect to the vertical plane 65; and the top surface and the bottom surface of each of the connecting portions 63, 63, 33, 43 are formed into vertically symmetric shapes with respect to the horizontal plane 66 passing the centers or nearly the centers of the connecting portions 63, 63, 33, 43. Consequently, even in a case where two circuits or elements (for example, an internal ANT and a RF circuit) laid out on the printed wiring board 1, 2 are arranged inversely, the same coaxial connector with a switch can be used through the reverse mounting, which makes it possible to use the coaxial connector with a switch commonly. It is thus possible to save the costs by suppressing an increase of the manufacturing facilities.

According to another aspect of the invention, a horizontal plane passing the center or nearly the center of the shell 6 is given as the horizontal plane 66. It is thus possible to make the heights of the coaxial connector with a switch from the main surface and from the back surface of the printed wiring board 1, 2 nearly equal when mounted.

According to another aspect of the invention, the shell 6 includes the main body portion 62 allowed to engage with notch portions 11, 21; the main body portion 62 includes the upper main body portion 62*a* and the lower main body portion 62*b* partitioned vertically at the horizontal plane 66; and one of the upper main body portion 62*a* and the lower main body portion 62*b* is formed into a shape allowed to engage with only one of two kinds of notch portions 11, 21, and the other is formed into a shape allowed to engage with only the other one of the notch portions 11, 21. It is thus possible to prevent erroneous mounting while reducing the protrusion length from the edge of the printed wiring board 1, 2 when mounted.

According to another aspect of the invention, the lower main body portion 62*b* is formed to have a breadth W slightly less than an opening width V of the notch portion 11, and the upper main body portion 62*a* is formed to have two steps having a breadth W1 slightly less than an opening width V1 on an opening side of the notch portion 21 and a breadth W2 slightly less than an opening width V2 on an inner side, so that a relation, W1>W>W2, is established. It is thus possible to make the outside shape of the shell 6 and the shapes of the notch portions 11, 21 simple.

According to another aspect of the invention, the coaxial connector 10 with a switch includes the normally closed terminal 3, the common terminal 4, the insulator 5, the shell 6, and the housing 7, and being mounted on the edge of the printed wiring board 1, 2, wherein: the pair of connecting portions 63 and 63 of the shell 6 are placed at horizontally symmetric positions with respect to the vertical plane 74 passing the center or nearly the center of the housing 7; the connecting portion 33 of the normally closed terminal 3 and the connecting portion 43 of the common terminal 4 are placed at horizontally symmetric positions with respect to the vertical plane 74; and the top surface and the bottom surface of each of the connecting portions 63, 63, 33, 43 are formed into vertically symmetric shapes with respect to the horizontal plane 75 passing the centers or nearly the centers of the connecting portions 63, 63, 33, 43. Consequently, as with the aspect of the invention in which two circuits or elements (for example, an internal ANT and a RF circuit) laid out on the printed wiring board 1, 2 are arranged inversely, the same coaxial connector 10 with a switch can be used through the reverse mounting, which makes it possible to use the coaxial connector with a switch commonly. It is thus possible to save the costs by suppressing an increase of the manufacturing facilities.

According to another aspect of the invention, a horizontal plane passing the center or nearly the center of the housing 7 is given as the horizontal plane 75. It is thus possible to, as with an aspect of the invention described above, make the heights of the coaxial connector with a switch from the main surface and from the back surface of the printed wiring board 1, 2 nearly equal when mounted.

According to another aspect of the invention, the housing 7 includes the main body portion 72 allowed to engage with the notch portions 11, 21; the main body 72 includes the upper main body portion 72*a* and the lower main body portion 72*b* partitioned vertically at the horizontal plane 75; and one of the upper main body portion 72*a* and the lower main body portion 72*b* is formed into a shape allowed to engage with only one of the notch portions 11, 21, and the other is formed into a shape allowed to engage with only the other one of the notch portions 11, 21. It is thus possible to prevent erroneous mounting while reducing the protrusion length from the edge of the printed wiring board 1, 2 when mounted.

According to another aspect of the invention, the lower main body portion 72*b* is formed to have a breadth W slightly less than an opening width V of the notch portion 11, and the upper main body portion 72*a* is formed to have two steps having a breadth W1 slightly less than an opening width V1 on an opening side of the notch portion 21 and a breadth W2 slightly less than an opening width V2 on an inner side, so that a relation, W1>W>W2, is established. It is thus possible to make the outside shape of the housing 7 and the shapes of the notch portions 11, 21 simple.

According to another aspect of the invention, the housing 7 is provided with key slots 82 and 83*a* through 83*e* allowed to engage with key protrusions provided to the mating connector 9. It is thus possible to prevent erroneous fitting with the mating connector 9.

What is claimed is:

1. A coaxial connector with a switch, the coaxial connector comprising:

a normally closed terminal and a common terminal whose respective contact portions contact and move apart from each other in association with removal and insertion of a mating connector;

an insulator for holding the normally closed terminal and the common terminal; and a shell for holding the insulator from outside, a connecting portion of the normally closed terminal, a connecting portion of the common terminal, and a pair of connecting portions of the shell protruding in a horizontal direction to be placed on corresponding lands formed on a surface of a printed wiring board near an edge thereof, the coaxial connector being mounted onto the edge of the printed wiring board through soldering of each connecting portion of the normally closed terminal, the common terminal, and the shell, wherein:

the pair of connecting portions of the shell are placed at horizontally symmetric positions with respect to a vertical plane passing a center or nearly the center of the shell;

the connecting portion of the normally closed terminal and the connecting portion of the common terminal are placed at horizontally symmetric positions with respect to the vertical plane; and a top surface and a bottom surface of each of the connecting portions of the normally closed terminal, the common terminal, and the shell are formed into vertically symmetric shapes with respect to a horizontal plane passing centers or nearly the centers of the connecting portions.

2. The coaxial connector with a switch according to claim 1, wherein:

the shell comprises a main body portion allowed to engage with two kinds of notch portions having different shapes, each formed by making a notch of the shape in the edge of the printed wiring board;

the main body portion comprises an upper main body portion and a lower main body portion partitioned vertically at the horizontal plane passing the centers or nearly the centers of the connecting portions; and one of the upper main body portion and the lower main body portion is formed into a shape allowed to engage with only one of the two kinds of notch portions, and the other is formed into a shape allowed to engage with only the other one of the two kinds of notch portions.

3. The coaxial connector with a switch according to claim 2, wherein:

one of the two kinds of notch portions is formed to have an opening width of a constant value V from an opening side to an inner side, and the other is formed to have two steps having an opening width V1, where V1>V, on the opening side and an opening width V2, where V2<V, on the inner side;

the lower main body portion is formed to have a breadth of a constant value W slightly less than V; and the upper main body portion is formed to have two steps having a breadth W2, which takes a value slightly less than V2, on an engagement tip end side and a breadth W1, which takes a value slightly less than V1, on an engagement rear end side.

4. The coaxial connector with a switch according to claim 1, wherein the horizontal plane passing the centers or nearly the centers of the connecting portions is a horizontal plane passing the center or nearly the center of the shell.

5. The coaxial connector with a switch according to claim 4, wherein:

the shell comprises a main body portion allowed to engage with two kinds of notch portions having different shapes, each formed by making a notch of the shape in the edge of the printed wiring board;

the main body portion comprises an upper main body portion and a lower main body portion partitioned vertically at the horizontal plane passing the centers or nearly the centers of the connecting portions; and one of the upper main body portion and the lower main body portion is formed into a shape allowed to engage with only one of the two kinds of notch portions, and the other is formed into a shape allowed to engage with only the other one of the two kinds of notch portions.

6. The coaxial connector with a switch according to claim 5, wherein:

one of the two kinds of notch portions is formed to have an opening width of a constant value V from an opening side to an inner side, and the other is formed to have two steps having an opening width V1, where V1>V, on the opening side and an opening width V2, where V2<V, on the inner side;

the lower main body portion is formed to have a breadth of a constant value W slightly less than V; and the upper main body portion is formed to have two steps having a breadth W2, which takes a value slightly less than V2, on an engagement tip end side and a breadth W1, which takes a value slightly less than V1, on an engagement rear end side.

7. A coaxial connector with a switch, the coaxial connector comprising:

a normally closed terminal and a common terminal whose respective contact portions contact and move apart from each other in association with removal and insertion of a mating connector;

an insulator for holding the normally closed terminal and the common terminal;

a shell for holding the insulator from outside; and a housing for holding the shell from outside, a connecting portion of the normally closed terminal, a connecting portion of the common terminal, and a pair of connecting portions of the shell protruding in a horizontal direction to be placed on corresponding lands formed on a surface of a printed wiring board near an edge thereof, the coaxial connector being mounted onto the edge of the printed wiring board through soldering of each connecting portion of the normally closed terminal, the common terminal, and the shell, wherein:

the pair of connecting portions of the shell are placed at horizontally symmetric positions with respect to a vertical plane passing a center or nearly the center of the housing;

the connecting portion of the normally closed terminal and the connecting portion of the common terminal are placed at horizontally symmetric positions with respect to the vertical plane; and a top surface and a bottom surface of each of the connecting portions of the normally closed terminal, the common terminal, and the shell are formed into vertically symmetric shapes with respect to a horizontal plane passing centers or nearly the centers of the connecting portions.

8. The coaxial connector with a switch according to claim 7, wherein the housing further comprises key slots allowed to engage with key protrusions on the mating connector.

9. The coaxial connector with a switch according to claim 7, wherein:

the housing comprises a main body portion allowed to engage with two kinds of notch portions having different shapes, each formed by making a notch of the shape in the edge of the printed wiring board;

the main body portion comprises an upper main body portion and a lower main body portion partitioned vertically at the horizontal plane passing the centers or nearly the centers of the connecting portions; and one of the upper main body portion and the lower main body portion is formed into a shape allowed to engage with only one of the two kinds of notch portions, and the other is formed into a shape allowed to engage with only the other one of the two kinds of notch portions.

10. The coaxial connector with a switch according to claim 9, wherein the housing further comprises key slots allowed to engage with key protrusions on the mating connector.

11. The coaxial connector with a switch according to claim 9, wherein:

one of the two kinds of notch portions is formed to have an opening width of a constant value V from an opening side to an inner side, and the other is formed to have two steps having an opening width V1, where V1>V, on the opening side and an opening width V2, where V2<V, on the inner side;

the lower main body portion is formed to have a breadth of a constant value W slightly less than V; and the upper main body portion is formed to have two steps having a breadth W2, which takes a value slightly less than V2, on an engagement tip end side and a breadth W1, which takes a value slightly less than V1, on an engagement rear end side.

12. The coaxial connector with a switch according to claim 11, wherein the housing further comprises key slots allowed to engage with key protrusions on the mating connector.

13. The coaxial connector with a switch according to claim 7, wherein the horizontal plane passing the centers or nearly the centers of the connecting portions is a horizontal plane passing the center or nearly the center of the housing.

14. The coaxial connector with a switch according to claim 13, wherein the housing further comprises key slots allowed to engage with key protrusions on the mating connector.

15. The coaxial connector with a switch according to claim 13, wherein:

the housing comprises a main body portion allowed to engage with two kinds of notch portions having different shapes, each formed by making a notch of the shape in the edge of the printed wiring board;

the main body portion comprises an upper main body portion and a lower main body portion partitioned vertically at the horizontal plane passing the centers or nearly the centers of the connecting portions; and one of the upper main body portion and the lower main body portion is formed into a shape allowed to engage with only one of the two kinds of notch portions, and the other is formed into a shape allowed to engage with only the other one of the two kinds of notch portions.

16. The coaxial connector with a switch according to claim 15, wherein the housing further comprises key slots allowed to engage with key protrusions on the mating connector.

17. The coaxial connector with a switch according to claim 15, wherein:

one of the two kinds of notch portions is formed to have an opening width of a constant value V from an opening side to an inner side, and the other is formed to have two steps having an opening width V1, where V1>V, on the opening side and an opening width V2, where V2<V, on the inner side;

the lower main body portion is formed to have a breadth of a constant value W slightly less than V; and the upper main body portion is formed to have two steps having a breadth W2, which takes a value slightly less than V2, on an engagement tip end side and a breadth W1, which takes a value slightly less than V1, on an engagement rear end side.

18. The coaxial connector with a switch according to claim 17, wherein the housing further comprises key slots allowed to engage with key protrusions on the mating connector.

* * * * *